US010794243B2

(12) United States Patent
Tanaka et al.

(10) Patent No.: US 10,794,243 B2
(45) Date of Patent: Oct. 6, 2020

(54) LUBRICATION STRUCTURE OF INTERNAL COMBUSTION ENGINE

(71) Applicant: SUZUKI MOTOR CORPORATION, Hamamatsu-shi, Shizuoka (JP)

(72) Inventors: Koichi Tanaka, Hamamatsu (JP); Kunio Arase, Hamamatsu (JP)

(73) Assignee: SUZUKI MOTOR CORPORATION, Hamamatsu-shi, Shizuoka (JP)

( * ) Notice: Subject to any disclaimer, the term of this patent is extended or adjusted under 35 U.S.C. 154(b) by 111 days.

(21) Appl. No.: 16/130,561

(22) Filed: Sep. 13, 2018

(65) Prior Publication Data

US 2019/0085739 A1 Mar. 21, 2019

(30) Foreign Application Priority Data

Sep. 19, 2017 (JP) ..... 2017-178648

(51) Int. Cl.
*F01M 1/06* (2006.01)
*F01M 1/02* (2006.01)
(Continued)

(52) U.S. Cl.
CPC ..... *F01M 1/06* (2013.01); *F01M 1/02* (2013.01); *F02F 7/006* (2013.01);
(Continued)

(58) Field of Classification Search
CPC ... F01M 2001/0238; F01M 2001/0253; F01M 2001/0261; F01M 2001/0269;
(Continued)

(56) References Cited

U.S. PATENT DOCUMENTS 7,040,454 B2 5/2006 Kawamoto et al. ..... 184/106
8,316,815 B2 11/2012 Negoro et al. ..... 123/195 C
(Continued)

FOREIGN PATENT DOCUMENTS

JP 2005180488 A * 7/2005 ..... F16H 57/0434
JP 2009121326 A * 6/2009 ..... F01M 1/02
JP 4583185 B2 11/2010

OTHER PUBLICATIONS

English machine translation of JP-2005180488-A provided by Espacenet (Year: 2020).*
(Continued)

*Primary Examiner* — Jacob M Amick
*Assistant Examiner* — Michael A Kessler
(74) *Attorney, Agent, or Firm* — Stein IP, LLC

(57) ABSTRACT

There is provided a lubrication structure of an internal combustion engine. A transmission chamber is arranged adjacently at the rear of a crank chamber. An oil chamber communicates with a bottom part of the transmission chamber. A feed pump supplies oil in the oil chamber to a lubrication target part. A scavenging pump sucks the oil in the crank chamber and discharges the oil to the transmission chamber. The feed pump and the scavenging pump are arranged coaxially in a width direction of the internal combustion engine. At least a part of the scavenging pump is arranged higher than a lower end of the crank chamber. A rear end of the scavenging pump is arranged at the same position as a rear end of the crank chamber or in front of the rear end of the crank chamber in a front and rear direction.

6 Claims, 16 Drawing Sheets

(51) Int. Cl.
*F02F 7/00* (2006.01)
*F02F 1/20* (2006.01)

(52) U.S. Cl.
CPC ..... *F01M 2001/0238* (2013.01); *F01M 2001/0269* (2013.01); *F02F 1/20* (2013.01)

(58) Field of Classification Search
CPC ..... F01M 2001/123; F01M 2001/126; F01M 1/02; F01M 1/12; F01M 11/02
USPC ..... 123/196 R
See application file for complete search history.

(56) References Cited

U.S. PATENT DOCUMENTS

| | | | | |
|---|---|---|---|---|
| 2002/0007984 | A1* | 1/2002 | Ito | F01M 1/02 184/6.5 |
| 2005/0193974 | A1 | 9/2005 | Terada et al. | 123/196 R |
| 2013/0333980 | A1* | 12/2013 | Tsunashima | F01M 1/02 184/6.5 |
| 2016/0084147 | A1* | 3/2016 | Sotani | F01M 1/02 123/196 A |
| 2016/0281554 | A1 | 9/2016 | Hatae et al. | F01M 1/02 |
| 2018/0283528 | A1* | 10/2018 | Tanaka | F02B 61/06 |

OTHER PUBLICATIONS

Indian Office Action dated Jan. 1, 2020, issued to Indian Patent Application No. 201814034579.

* cited by examiner

LUBRICATION STRUCTURE OF INTERNAL COMBUSTION ENGINE

CROSS-REFERENCE TO RELATED APPLICATIONS

The disclosure of Japanese Patent Application No. 2017-178648 filed on Sep. 19, 2017, including specification, drawings and claims is incorporated herein by reference in its entirety.

TECHNICAL FIELD

The present invention relates to a lubrication structure of an internal combustion engine.

BACKGROUND

A lubrication structure configured to supply oil for lubrication into an engine and including a scavenging pump and a feed pump has been known. The feed pump is configured to pump up oil retained at an oil fan of a bottom part of the engine and to supply the oil to each lubrication part provided at diverse places of the engine. The oil having lubricated a cylinder and a crankshaft and accumulated on a bottom part of a crank chamber is discharged to an outside of the crank chamber by the scavenging pump. When the crankshaft rotates with being immerged in an excessive amount of oil and stirring the oil, a resistance is generated. When the oil in the crank chamber is discharged using the scavenging pump, it is possible to prevent a loss in drive force of the crankshaft, which is caused due to the stirring of the oil.

For example, according to a lubrication structure disclosed in Patent Document 1, the scavenging pump is arranged at a position lower than the lowest surface of the crank chamber, and is configured to discharge the oil toward a transmission chamber provided at the rear of the crank chamber. The oil fan is provided below the transmission chamber, and the feed pump is configured to pump up the oil from the oil fan and to supply the oil to the lubrication parts of the engine.

Patent Document 1: Japanese Patent No. 4,583,185 B

When the scavenging pump is provided at a position lower than the lowest surface of the crank chamber, like Patent Document 1, the miniaturization of the engine, particularly the size-down in a vertical direction is limited. Also, a gear for transmitting rotation of the crankshaft to the scavenging pump is also positioned below, like the scavenging pump. Thus, a gear for pump drive is in a state in which it is immersed in the oil retained at the lower part of the engine and stirs the oil all the time, so that the loss in drive force due to the resistance may be increased. In order to prevent this, when a position of an oil surface relative to the gear for pump drive is lowered, a position of the oil fan is lowered. As a result, when the engine is mounted to a vehicle and the like, the lowest ground height of the engine is lowered.

Also, when the engine is enlarged or the position of the oil fan is lowered, an oil passage from the oil fan to the feed pump is lengthened. When the oil passage is long, a pressure loss increases and the oil supply ability of the feed pump is lowered, so that the lubrication on each part of the engine may be deteriorated.

Also, according to the lubrication structure of Patent Document 1, the oil is directly discharged from the scavenging pump toward the transmission. For this reason, the oil is excessively supplied to the transmission, so that the loss in drive force or air bubbles in the oil, which is caused due to the oil stirring of the transmission, is likely to occur.

SUMMARY

It is therefore one of objects of the present invention to provide a lubrication structure of an internal combustion engine, which is compact, hardly suffers loss in drive force and has excellent lubrication performance.

A lubrication structure of an internal combustion engine of the present invention is a lubrication structure of an internal combustion engine including a crank chamber having a crankshaft provided therein, a transmission chamber arranged adjacently at the rear of the crank chamber and having a transmission mechanism provided therein, an oil chamber configured to communicate with a bottom part of the transmission chamber, a feed pump configured to supply oil in the oil chamber to a lubrication target part, and a scavenging pump configured to suck the oil accumulated in the crank chamber and to discharge the oil to the transmission chamber, wherein the feed pump and the scavenging pump are arranged coaxially in a width direction of the internal combustion engine, in which a rotary shaft of the crankshaft extends, at least a part of the scavenging pump is arranged at a position higher than a lower end of the crank chamber, and a rear end of the scavenging pump is arranged at the same position as a rear end of the crank chamber or in front of the rear end of the crank chamber in a front and rear direction.

According to the present invention, the pump for lubrication and an oil passage are optimally arranged, so that it is possible to provide the lubrication structure of an internal combustion engine, which is compact, hardly suffers loss in drive force and has excellent lubrication performance.

DETAILED DESCRIPTION OF THE EMBODIMENTS

Hereinafter, an illustrative embodiment of the present invention will be described in detail with reference to the accompanying drawings. In below descriptions, respective front, rear, left, right, upper and lower directions indicate directions, as seen from a passenger when an internal combustion engine (an engine unit 10) of the illustrative embodiment is mounted to a motorcycle. The right and left direction is a width direction of the engine unit 10. In the meantime, the target to which the internal combustion engine relating to the present invention is to be mounted is not limited to the motorcycle, and the present invention can be applied to an internal combustion engine of a four-wheeled vehicle, a ship and the like, as well.

Figure 1:
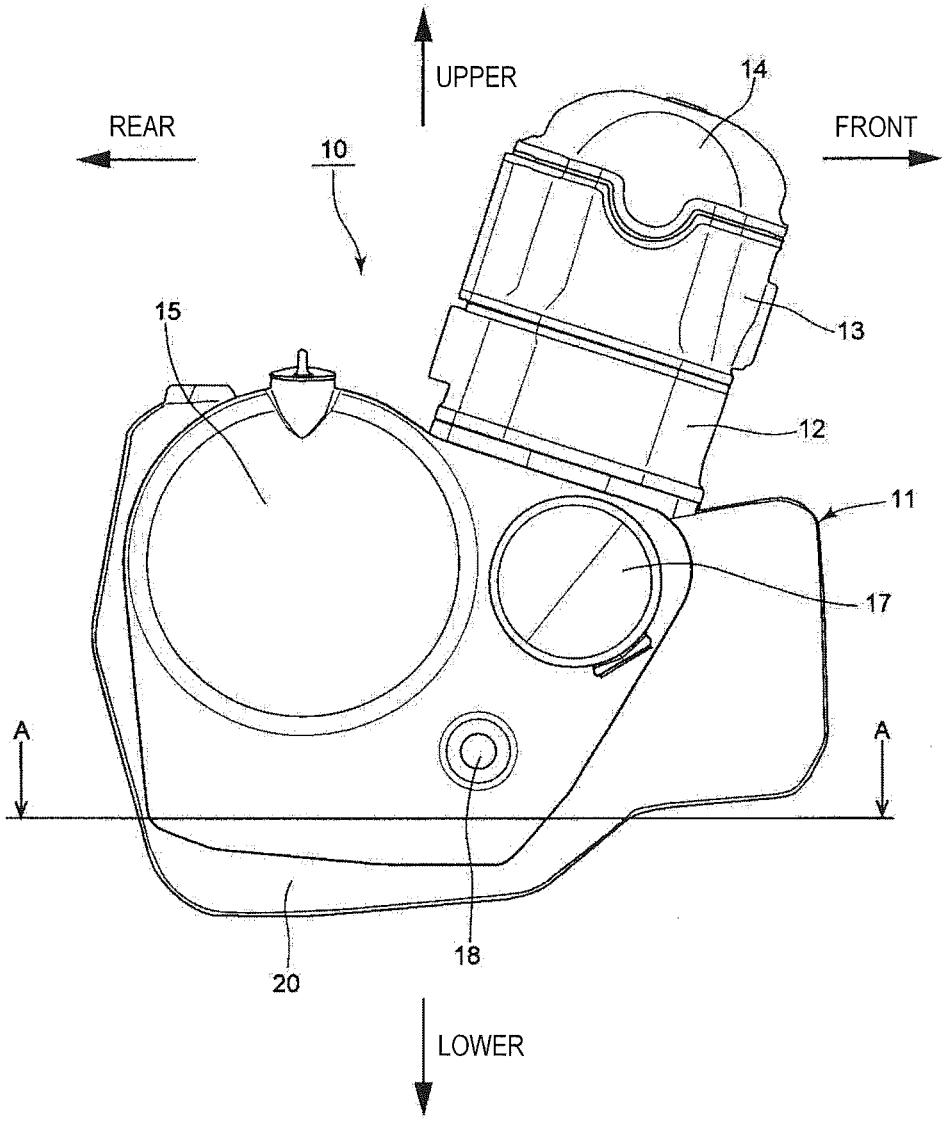
FIG. 1 is a side view of an engine unit of an illustrative embodiment, as seen from the right side.
Figure 2:
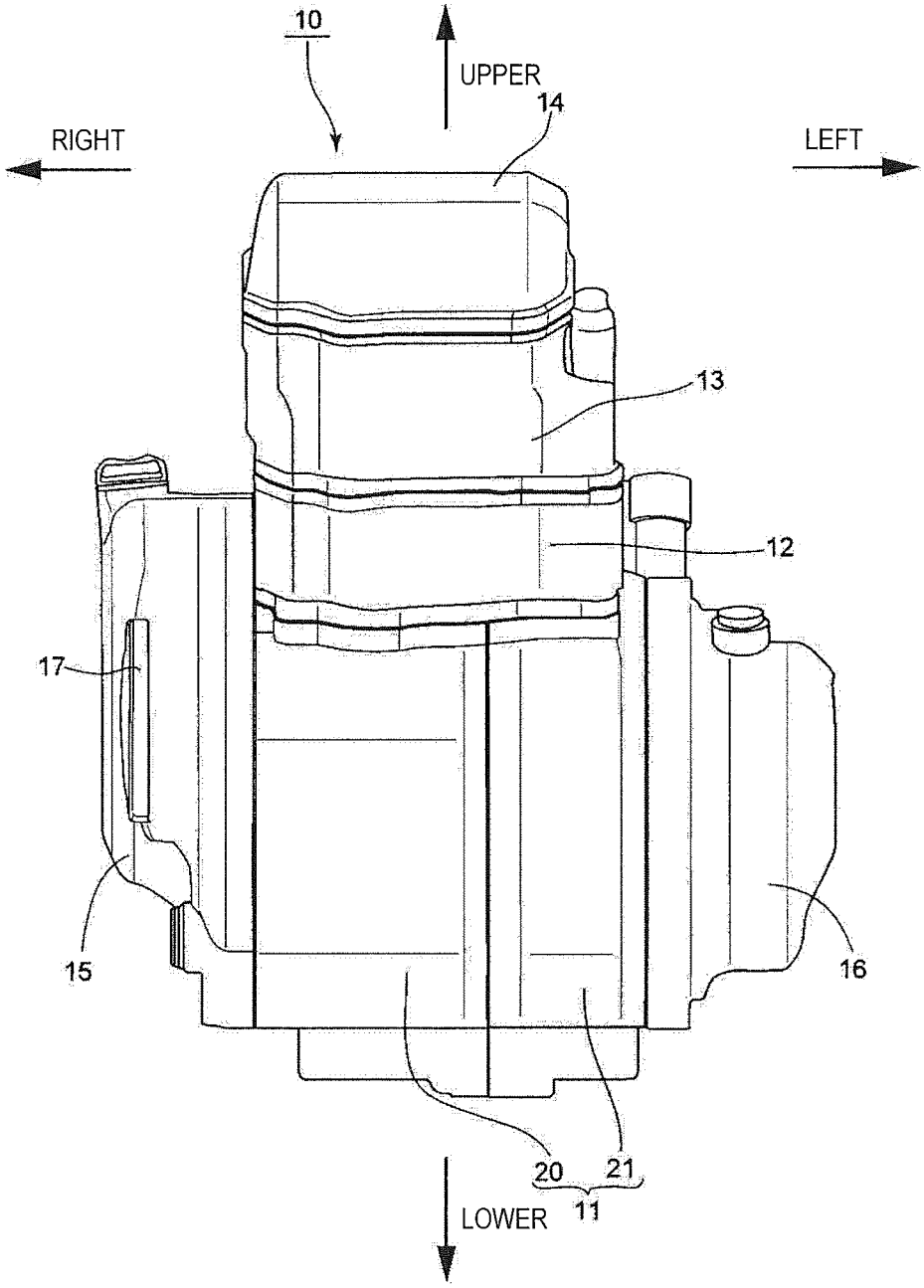
FIG. 2 is a front view of the engine unit of the illustrative embodiment.
Figure 3:
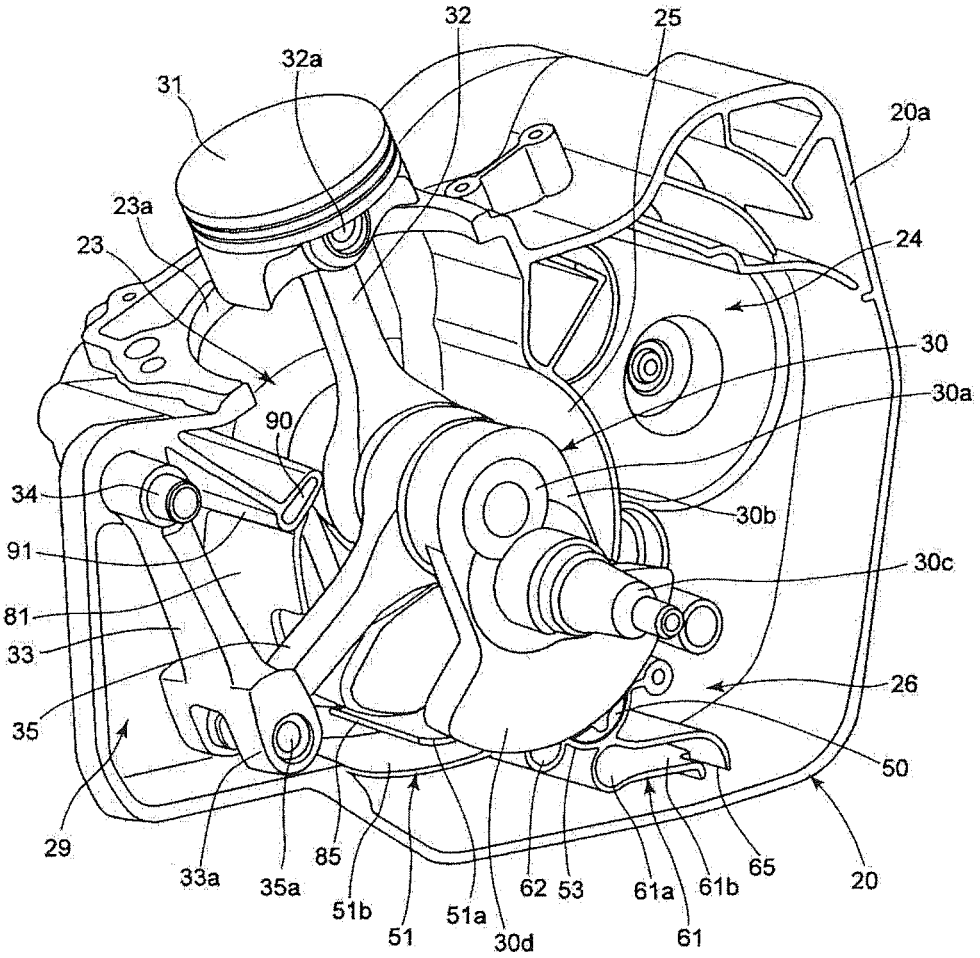
FIG. 3 is a perspective view depicting an inside of a right crankcase.

FIGS. 1 and 2 depict an outward appearance of the engine unit 10 of the illustrative embodiment. The engine unit 10 includes a cylinder 12 provided at an upper part of a crankcase 11, and a cylinder head 13 and a cylinder head cover 14 provided above the cylinder 12. A clutch cover 15 is mounted to a right side of the crankcase 11, and a magneto cover 16 is mounted to a left side of the crankcase 11. Also, an oil filter 17 that is detachably mounted to the clutch cover 15 is provided. In the meantime, an intake system and an exhaust system of the engine unit 10 are not shown.

Figure 4:
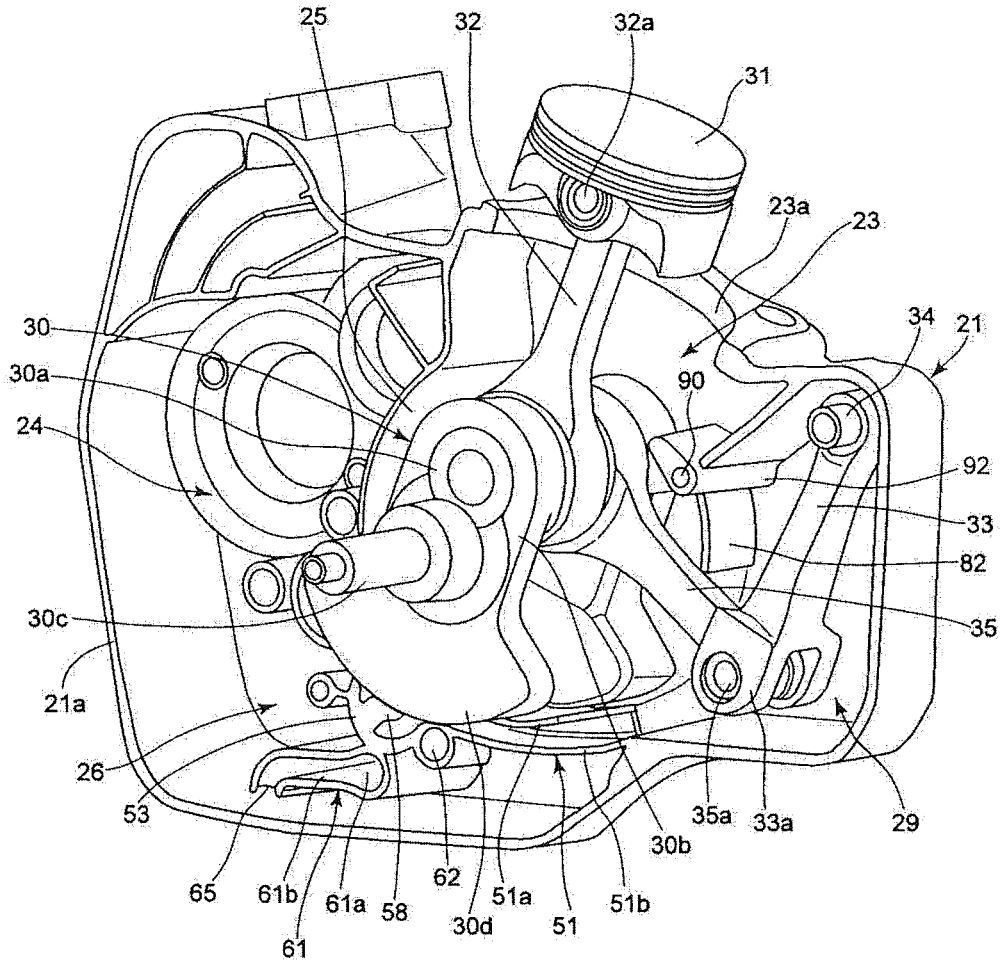
FIG. 4 is a perspective view depicting an inside of a left crankcase.
Figure 10:
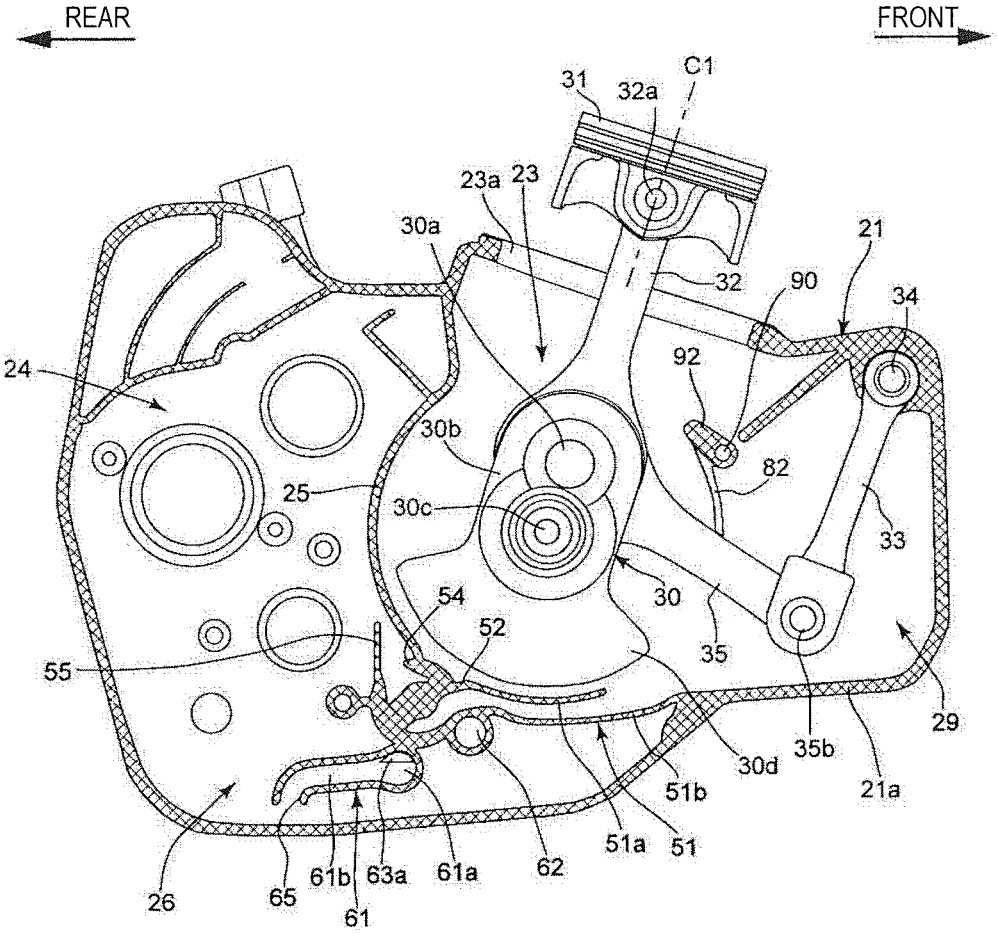
FIG. 10 is a side view of the left crankcase, as seen from the right side.

As shown in FIG. 2, the crankcase 11 is configured by combining a right crankcase 20, which is a case half body positioned at the right, and a left crankcase 21, which is a case half body positioned at the left. The right crankcase 20 and the left crankcase 21 have a mating surface 20*a* and a mating surface 21*a* facing each other. The right crankcase 20 and the left crankcase 21 are fastened and fixed with the mating surface 20*a* and the mating surface 21*a* being in contact with each other, so that the crankcase 11 is formed. The mating surface 20*a* and the mating surface 21*a* are air-tightly sealed therebetween. FIGS. 3, 5, 6 and 7 depict an inside of the right crankcase 20, as seen from the mating surface 20*a*, and FIGS. 4 and 10 depict an inside of the left crankcase 21, as seen from the mating surface 21*a*.

In the crankcase 11 configured by combining the right crankcase 20 and the left crankcase 21, a crank chamber 23 and a transmission chamber 24 are formed. An upper surface of the crank chamber 23 is formed with a cylinder communication port 23*a* configured to communicate with a cylinder bore (not shown) in the cylinder 12. The crank chamber 23 and the transmission chamber 24 are partitioned in the front and rear direction by a partition wall 25, so that the crank chamber 23 is positioned in front of the partition wall 25 and the transmission chamber 24 is positioned at the rear of the partition wall 25. The partition wall 25 is configured by combining a wall part protruding leftward from an inner surface of the right crankcase 20 and a wall part protruding rightward from an inner surface of the left crankcase 21, and end faces of the wall parts are included in the mating surface 20*a* and the mating surface 21*a*.

Figure 8:
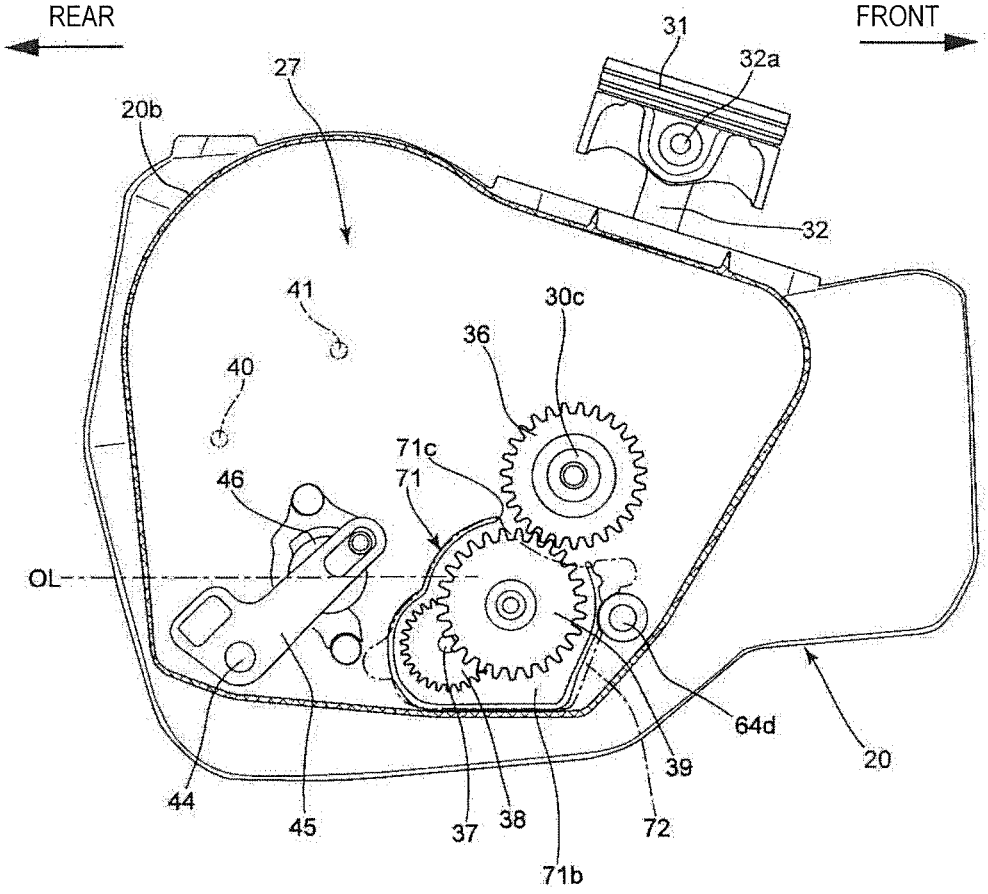
FIG. 8 is a side view of the right crankcase, as seen from the right side.
Figure 9:
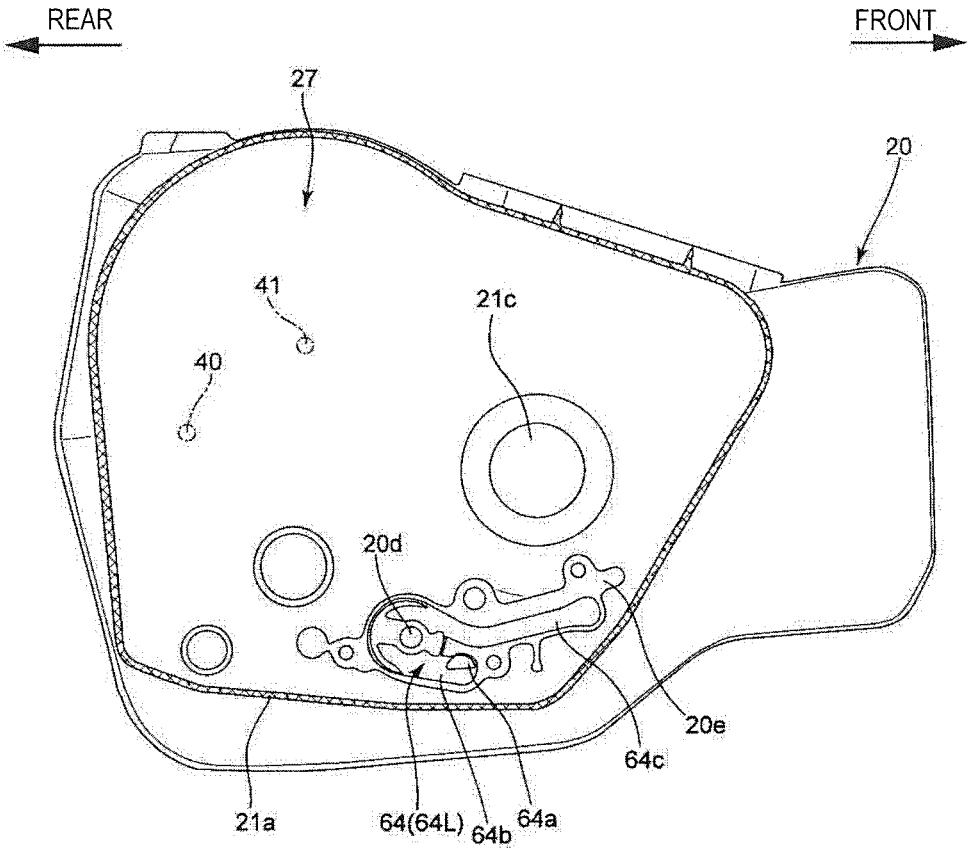
FIG. 9 is a side view depicting the right crankcase, in which components of the driving system are demounted, as seen from the right side.

As shown in FIGS. 8 and 9, the right crankcase 20 has a mating surface 20*b* at a right side surface, which is opposite to the mating surface 20*a*. The clutch cover 15 and the right crankcase 20 are fastened and fixed with a mating surface (not shown) of the clutch cover 15 being in contact with the mating surface 20*b*. A clutch chamber 27, which is a space surrounded by the mating surface 20*b*, is formed between the clutch cover 15 and the right crankcase 20.

Figure 11:
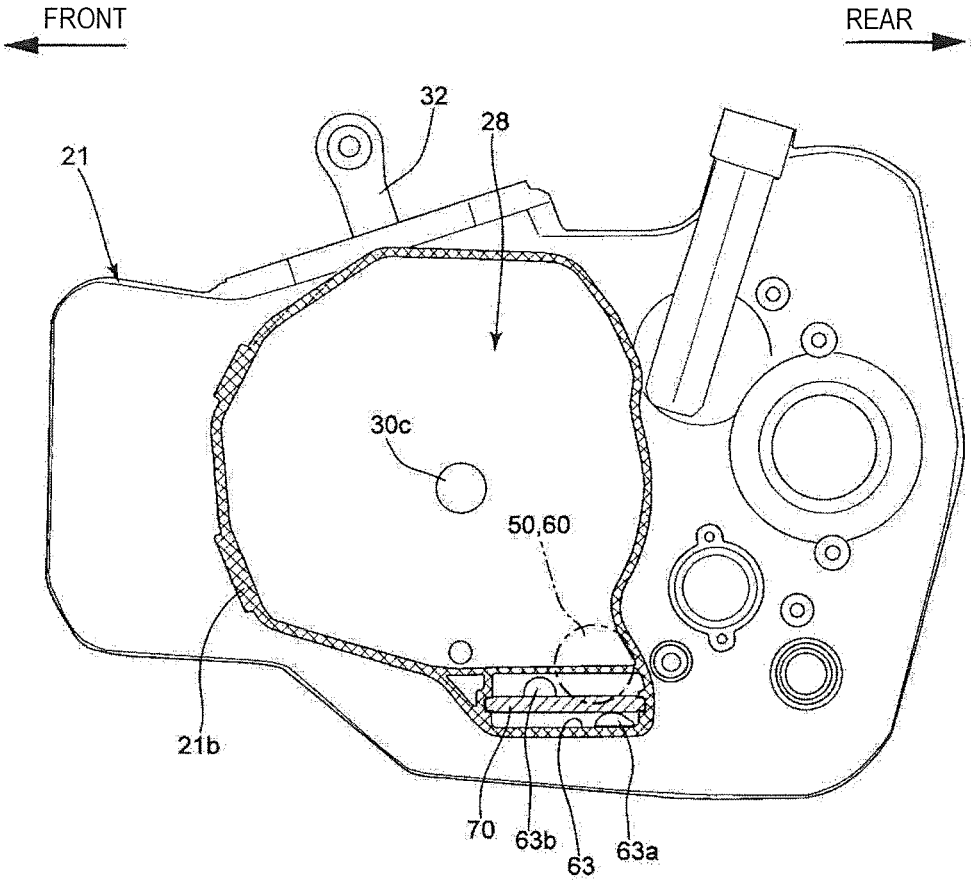
FIG. 11 is a side view of the left crankcase, as seen from the left side.

As shown in FIG. 11, the left crankcase 21 has a mating surface 21*b* at a left side surface, which is opposite to the mating surface 21*a*. The magneto cover 16 and the left crankcase 21 are fastened and fixed with a mating surface (not shown) of the magneto cover 16 being in contact with the mating surface 21*b*. A power generator chamber 28, which is a space surrounded by the mating surface 21*b*, is formed between the left crankcase 21 and the magneto cover 16.

In the crank chamber 23 of the crankcase 11, a crankshaft 30 having a rotary shaft arranged in parallel with the right and left direction (the width direction of the engine unit 10) is accommodated. The crankshaft 30 has a crank pin 30*a*, a pair of left and right crank webs 30*b* provided at both sides of the crank pin 30*a*, and a pair of left and right main journals 30*c* protruding laterally from the respective crank webs 30*b* at positions eccentric from the crank pin 30*a*. Each of the crank webs 30*b* is integrally formed with a counter weight 30*d* positioned at an opposite side to the crank pin 30*a* with respect to the main journal 30*c*. The counter weight 30*d* has an arc-shaped outer peripheral surface of which a center is the main journal 30*c*.

The left and right main journals 30*c* are coaxially positioned. The right main journal 30*c* is rotatably supported to a crank support hole 20*c* (refer to FIGS. 6 and 7) formed in the right crankcase 20, and the left main journal 30*c* is rotatably supported to a crank support hole 21*c* (refer to FIG. 9) formed in the left crankcase 21. That is, the crankshaft 30 is configured to rotate about an axis center of the main journal 30*c*.

The engine unit 10 is a single cylinder engine having a single cylinder bore in the cylinder 12. In the cylinder bore, a piston 31 is accommodated to be reciprocally moveable along a cylinder axis line C1 (refer to FIGS. 5 and 10) tilted slightly forward relative to the perpendicular direction. The piston 31 and the crankshaft 30 are connected via a connecting rod 32 for piston, and reciprocal movement of the piston 31 is converted into rotational movement of the crankshaft 30. A small end portion of the connecting rod 32 for piston is coupled to the piston 31 to be relatively rotatable via a coupling shaft 32*a*, and a large end portion of the connecting rod 32 for piston is coupled to the crank pin 30*a* to be relatively rotatable.

In the cylinder bore, a combustion chamber (not shown) surrounded by an inner wall surface of the cylinder 12, a lower surface of the cylinder head 13 and an upper surface of the piston 31 is formed. The cylinder head 13 is formed with an intake port (not shown) for sending air into the combustion chamber and an exhaust port (not shown) for discharging a combustion gas to an outside of the combustion chamber. Also, the cylinder head 13 is provided with an intake valve (not shown) configured to open and close the intake port and an exhaust valve (not shown) configured to open and close the exhaust port. Air and fuel introduced from an outside are mixed in a fuel injection device (not shown) and are then supplied to the combustion chamber. The cylinder head 13 is provided with an ignition plug (not shown) protruding from a lower surface thereof, so that the fuel-air mixture in the combustion chamber can be ignited by an electric discharge.

In the engine unit 10 configured to operate in a four-stroke manner, when the piston 31 descends, the intake valve is opened and the fuel-air mixture is sent to the combustion chamber. Then, the intake valve is closed and the piston 31 ascends to compress the fuel-air mixture. When the piston 31 reaches a top dead center, the fuel-air mixture ignited by the ignition plug and compressed is combusted. When a pressure in the combustion chamber increases as a result of the combustion of the fuel-air mixture, the piston 31 descends. The descent movement of the piston 31 is transmitted to the crankshaft 30 via the connecting rod 32 for piston, so that the crankshaft 30 rotates. Then, when the piston 31 descends to a bottom dead center and again ascends due to the inertia, the exhaust valve is opened, so that the combustion gas is discharged from the exhaust port.

In the crankcase 11, a balancer chamber 29 is formed in front of the crank chamber 23. The balancer chamber 29 is a space configured to communicate with the crank chamber 23, and a balancer weight 33 configured to swing in association with rotation of the crankshaft 30 is arranged in the balancer chamber 29. One end portion of the balancer weight 33 is swingably supported to a pivot pin 34 provided at an upper part of the balancer chamber 29. An axis line of the pivot pin 34 is parallel with the rotary shaft of the crankshaft 30, and the balancer weight 33 is configured to swing along a plane perpendicular to the rotary shaft of the crankshaft 30. The other end portion of the balancer weight 33 is formed with a weight part 33*a*. A weight of the balancer weight 33 is distributed so that the other end portion, at which the weight part 33*a* is provided, is heavier than one end portion that is supported to the pivot pin 34.

Figure 14:
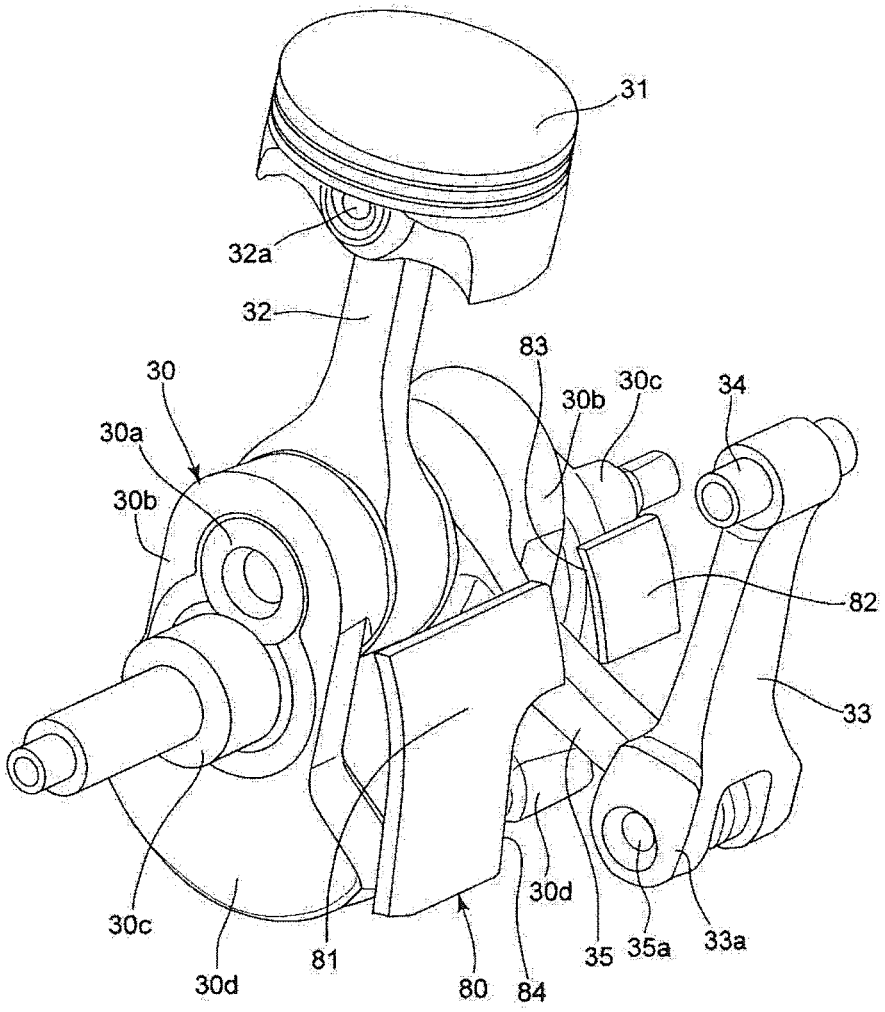
FIG. 14 is a perspective view of a partition wall configured to partition a crank chamber and a balancer chamber, and a balancer device, as seen from the oblique right side.
Figure 15:
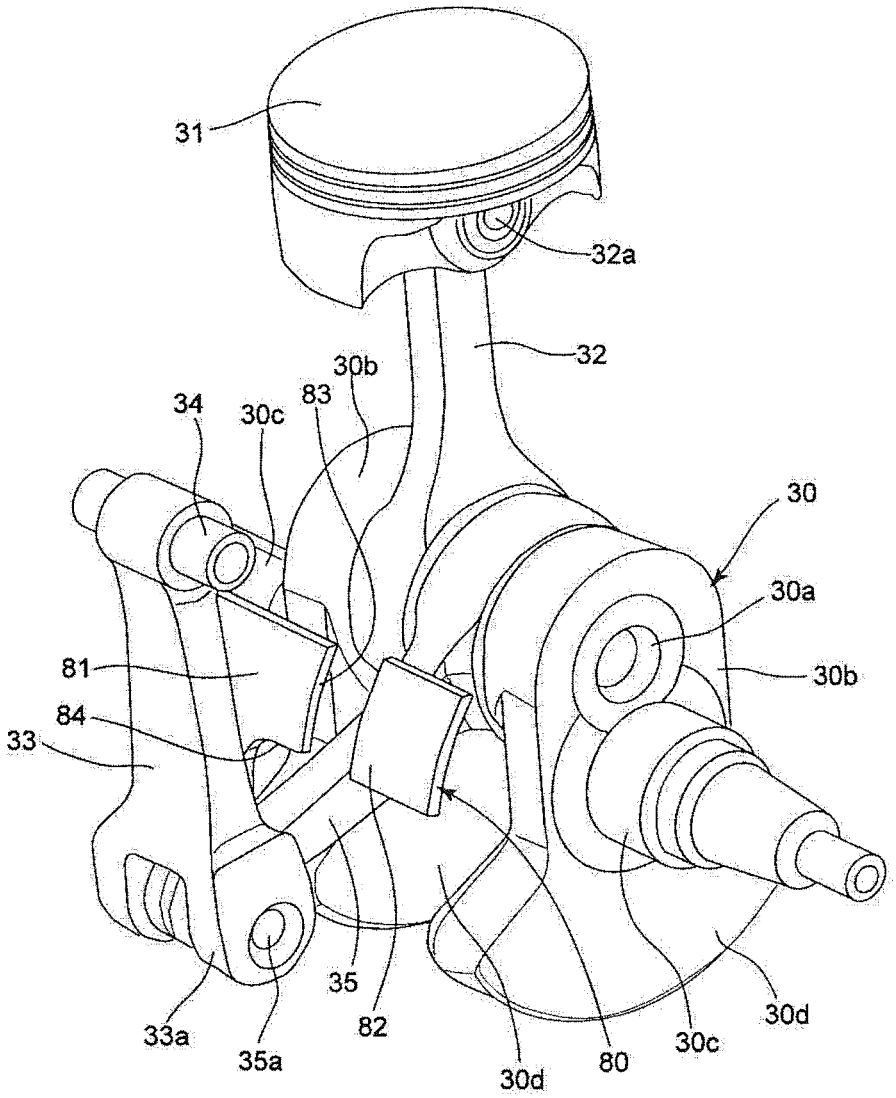
FIG. 15 is a perspective view of the partition wall configured to partition the crank chamber and the balancer chamber, and the balancer device, as seen from the oblique left side.
Figure 16:
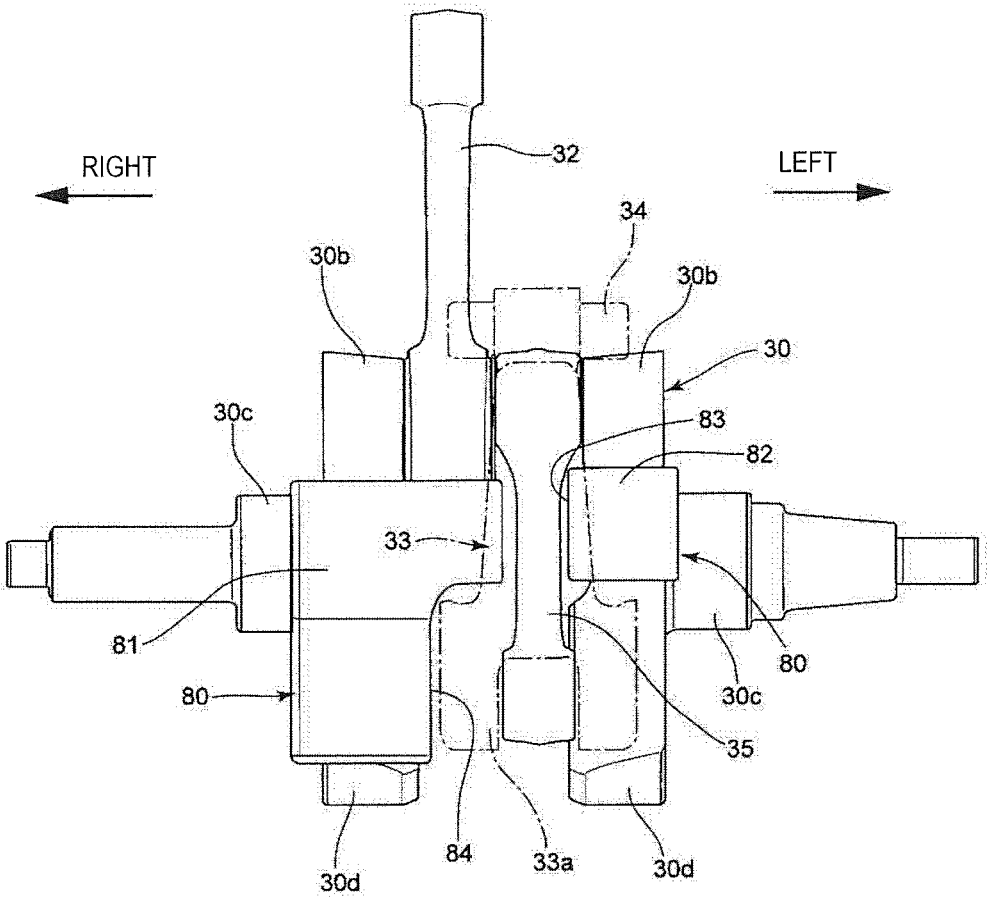
FIG. 16 is a front view of the partition wall configured to partition the crank chamber and the balancer chamber, and the balancer device.

A small end portion of a connecting rod 35 for balancer is coupled to be relatively rotatable to the weight part 33*a* of the balancer weight 33. More specifically, the weight part 33*a* has bifurcated portions, which face each other at left and right sides, and is formed with a shaft hole penetrating in the right and left direction. The small end portion of the connecting rod 35 for balancer is inserted between the bifurcated portions of the weight part 33*a*, and a coupling shaft 35*a* of the connecting rod 35 for balancer is rotatably supported to the shaft hole of the weight part 33*a*. A large end portion of the connecting rod 35 for balancer is rotatably supported to the crank pin 30*a* of the crankshaft 30. As shown in FIGS. 14 to 16, the large end portion of the connecting rod 32 for piston and the large end portion of the connecting rod 35 for balancer are arranged to be adjacent to each other on the crank pin 30*a*.

When the piston 31 reciprocally moves along the cylinder axis line C1 and thus the crankshaft 30 rotates, a position of the large end portion of the connecting rod 35 for balancer supported to the crank pin 30*a* changes in a rotating direction of which a center is the main journal 30*c*. Thus, a force of pushing and pulling the weight part 33*a* of the balancer weight 33 via the connecting rod 35 for balancer is applied, so that the balancer weight 33 swings in the front and rear direction about one end portion pivotally supported to the pivot pin 34. Based on a relation between the swinging of the balancer weight 33 and the change in position of the counter weight 30*d* provided to the crankshaft 30, the vibration due to the reciprocal movement of the piston 31 is alleviated (cancelled).

The rotation of the crankshaft 30 is extracted as power via a transmission. The transmission has a well-known structure and is briefly described. A tip end of the right main journal 30*c* of the crankshaft 30 protrudes into the clutch chamber 27, so that the power is transmitted to a clutch mechanism (not shown) arranged in the clutch chamber 27. The clutch mechanism can be switched between a power transmission state and a power cutoff state. In the power transmission state, the clutch mechanism transmits the rotation from the crankshaft 30 to a transmission mechanism provided in the transmission chamber 24. In the power cutoff state, the clutch mechanism cuts off the rotation transmission to the transmission mechanism.

Figure 5:
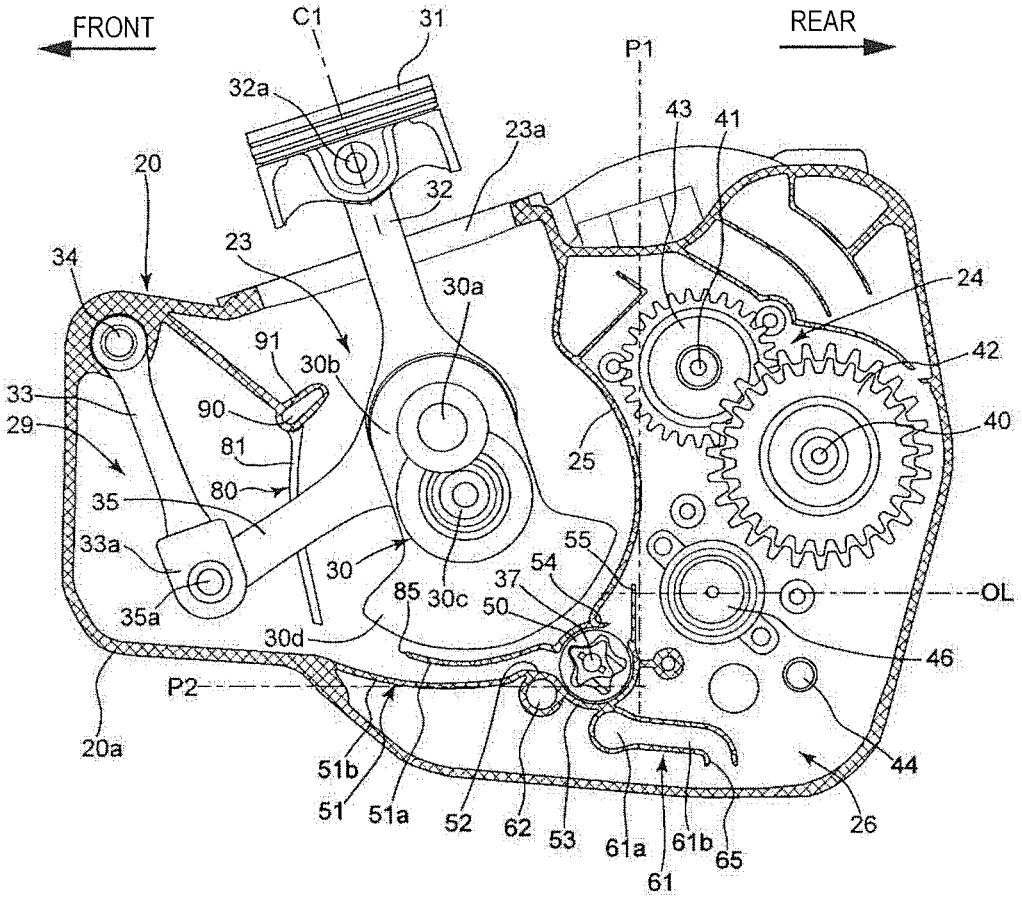
FIG. 5 is a side view of the right crankcase, as seen from the left side.

As shown in FIG. 5, the transmission chamber 24 is provided therein with a drive shaft 40 and a counter shaft 41 extending in the right and left direction, a gear group 42 is provided on the drive shaft 40, and a gear group 43 is provided on the counter shaft 41. The rotation is transmitted from the clutch mechanism in the power transmission state to the drive shaft 40. The gear group 42 and the gear group 43 are respectively configured by combining fixed gears fixed to the drive shaft 40 and the counter shaft 41 and configured to rotate together with the drive shaft 40 and the counter shaft 41, freewheelers configured to be rotatable relative to the drive shaft 40 and the counter shaft 41, slider gears capable of axially moving on the drive shaft 40 and the counter shaft 41, and the like.

As shown in FIG. 8, in the clutch chamber 27, a shift lever 45 is rotatably supported to a shift shaft 44. The shift lever 45 is configured to be rotatively operated by a shift pedal or the like (not shown). The rotation of the shift lever 45 is transmitted to a shift drum 46, and positions of shift forks (not shown) fitted to the respective slider gears of the gear group 42 and the gear group 43 are changed in correspondence to the rotation of the shift drum 46, so that a gear ratio is changed.

The power generator chamber 28 is provided therein with an alternator (not shown). The left main journal 30*c* of the crankshaft 30 is inserted in the power generator chamber 28 and is connected to the alternator, so that the rotation of the crankshaft 30 is transmitted to the alternator and power is thus generated.

The respective parts of the engine unit 10 is lubricated by engine oil so as to prevent wear and to secure a smooth operation. The engine oil (hereinafter, simply referred to as the oil) has cooling, airtightness maintaining, cleaning, rust-proofing and the like functions, in addition to the lubrication function. In the below, a lubrication structure of the engine unit 10 is described.

A bottom part of the crankcase 11 is provided with an oil chamber 26 for retaining therein the oil. The oil chamber 26 protrudes downward beyond the bottom part of the crank chamber 23, and a bottom part of the transmission chamber 24 is configured to communicate with the oil chamber 26. The right crankcase 20 and the left crankcase 21 are respectively formed with a plurality of through-holes for enabling an inside of the crankcase 11 and the clutch chamber 27 and power generator chamber 28 to communicate with each other. By the through-holes, the oil can flow between the inside of the crankcase 11 and the clutch chamber 27 and power generator chamber 28.

The oil having lubricated the crankshaft 30, the piston 31 and the like and having fallen in the crank chamber 23 is sucked and discharged to the transmission chamber 24 by a scavenging pump 50. The oil in the transmission chamber 24 falls to the oil chamber 26. The oil in the oil chamber 26 is pumped up and supplied to each lubrication target part of the engine unit 10 by a feed pump 60.

A reference amount of the oil in the engine unit 10 is set so that an oil level in a non-operating state of the engine is to be a reference oil surface position OL shown in FIGS. 5 and 8. As shown in FIG. 1, a right surface of the engine unit 10 is provided with an oil level check window 18 through which the oil level can be visually recognized from an outside. In an operating state of the engine, the oil surface position is lowered below the reference oil surface position OL.

Figure 17:
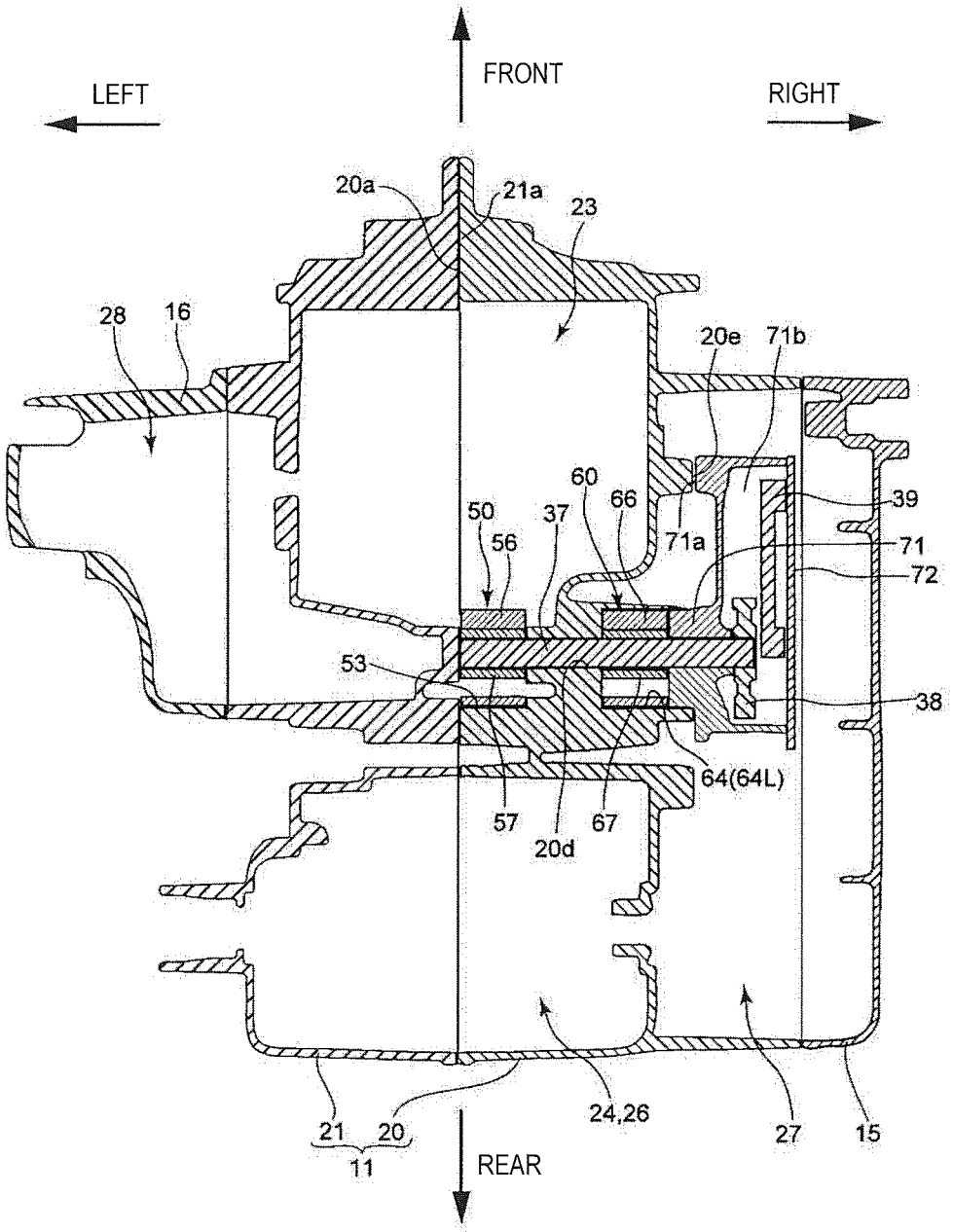
FIG. 17 is a sectional view taken along a line A-A of FIG. 1.

The scavenging pump 50 and the feed pump 60 are coaxially supported by a pump drive shaft 37 and configure a pump unit. The pump drive shaft 37 is inserted in a shaft hole 20*d* (refer to FIGS. 9 and 17) formed in the right crankcase 20 and is supported to be rotatable about an axis line extending toward the right and left direction. As shown in FIGS. 8 and 17, one end portion of the pump drive shaft 37 is connected to a pump driving gear 38 provided in the clutch chamber 27. The pump driving gear 38 is meshed with a relay gear 39, and the relay gear 39 is meshed with a prime mover gear 36 configured to rotate together with the main journal 30*c* of the crankshaft 30. Accordingly, when the crankshaft 30 rotates, the pump drive shaft 37 also rotates.

Figure 6:
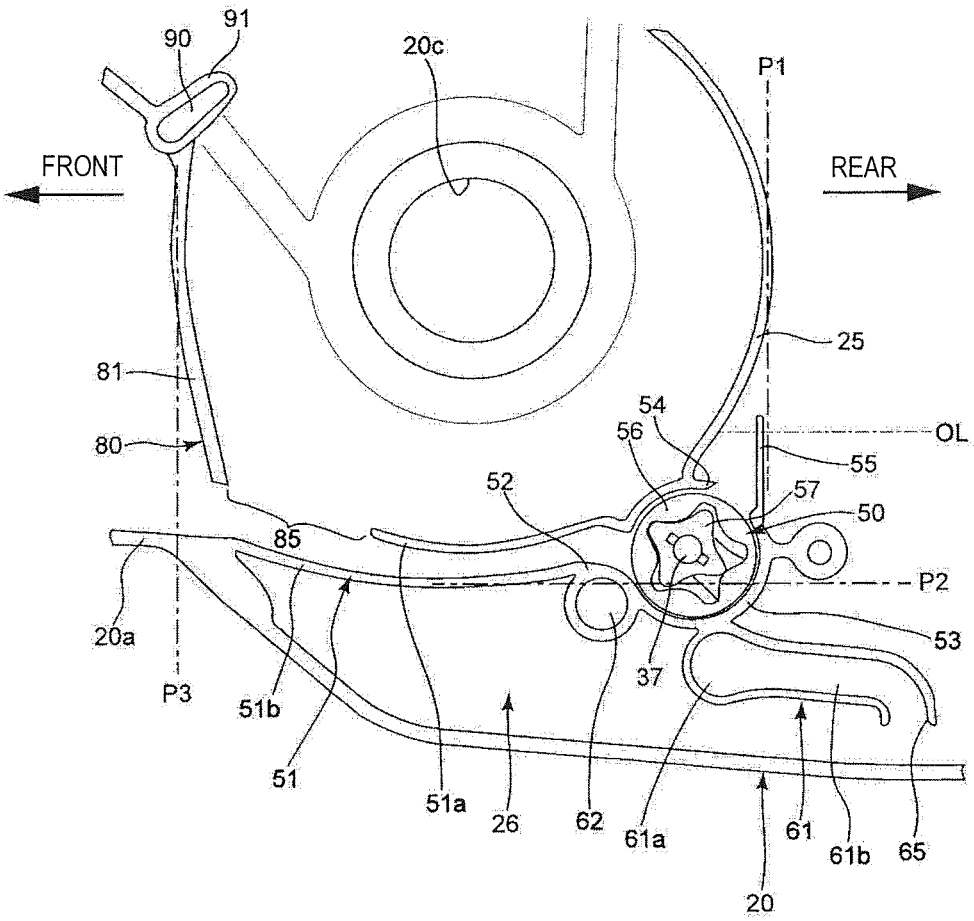
FIG. 6 is a partially enlarged side view of an internal structure of the right crankcase, as seen from the left side.

The partition wall 25 configured to partition the crank chamber 23 and the transmission chamber 24 has a curved shape convex toward the transmission chamber 24 (the rear). The curved shape of the partition wall 25 conforms to a moving locus of an outer periphery part of the counter weight 30*d* upon the rotation of the crankshaft 30, and the most rearward protruding part of the partition wall 25 is a rear end of the crank chamber 23. In FIGS. 5 and 6, a virtual line P1 passing through a position of the rear end of the crank chamber 23 (the partition wall 25) and extending in the perpendicular direction is shown.

The bottom part of the crank chamber 23 is formed with an oil suction passage 51. The oil suction passage 51 is configured by an upper curved wall 51*a* and a lower curved wall 51*b* facing with each other with being spaced in the vertical direction. The upper curved wall 51*a* has a curved shape convex downward, and the curved shape conforms to the moving locus of the outer periphery part of the counter weight 30*d* upon the rotation of the crankshaft 30. The lower curved wall 51*b* has a curved shape convex downward, similarly to the upper curved wall 51*a*. The crank chamber 23 and the oil chamber 26 are partitioned by the lower curved wall 51*b*, and the most downward protruding part of the lower curved wall 51*b* is a lower end of the crank chamber 23. In FIGS. 5 and 6, a virtual line P2 passing through a position of the lower end of the crank chamber 23 (the lower curved wall 51*b*) and extending in the horizontal direction is shown.

The oil suction passage 51 is positioned below the main journal 30*c* of the crankshaft 30, and a front end of the oil suction passage 51 is positioned ahead of an axis center of the main journal 30*c*. More specifically, a front end of the upper curved wall 51*a* is positioned at the rear of a front end of the lower curved wall 51*b*, and the oil having reached the bottom part of the crank chamber 23 enters the oil suction passage 51 through the front of the upper curved wall 51*a*. Since the front end of the lower curved wall 51*b* extends to a position at which it connects to a bottom part of the balancer chamber 29, the oil having passed through the front of the upper curved wall 51*a* does not directly fall to the oil chamber 26.

A rear end of the oil suction passage 51 is positioned at the rear of the axis center of the main journal 30*c*, and a suction port 52 is formed at a position that continues to the rear end of the oil suction passage 51. By the curved shapes of the upper curved wall 51*a* and the lower curved wall 51*b*, the rear end of the oil suction passage 51 opens obliquely upward. In correspondence to this, the suction port 52 opens obliquely upward, so that a flow path smoothly extending from the rear end of the oil suction passage 51 to the suction port 52 is formed.

A pump accommodation part 53 is formed at the rear of the suction port 52. The pump accommodation part 53 has a cylindrical internal space having the axis line thereof extending in the right and left direction, and the scavenging pump 50 is accommodated in the pump accommodation part 53. A discharge port 54 opening upward from the pump accommodation part 53 toward the transmission chamber 24 is formed. A discharge guide rib (the discharge guide part) 55 extends upward from a rear edge portion of the discharge port 54. The discharge guide rib 55 is a wall part extending substantially along the virtual line P1. In the illustrative embodiment, the discharge guide rib 55 is positioned slightly ahead of the virtual line P1, and the pump accommodation part 53 and the discharge port 54 are also positioned in front of the virtual line P1.

The oil suction passage 51, the suction port 52, the pump accommodation part 53, the discharge port 54 and the discharge guide rib 55 are formed integrally with the crankcase 11. All of the oil suction passage 51, the suction port 52, the discharge port 54 and the discharge guide rib 55 have a length traversing in the right and left direction in the crankcase 11. More specifically, each of the upper curved wall 51*a* and lower curved wall 51*b* of the oil suction passage 51, the suction port 52, the discharge port 54 and the discharge guide rib 55 is configured by combining a wall part protruding leftward from an inner surface of the right crankcase 20 and a wall part protruding rightward from an inner surface of the left crankcase 21 (bringing the wall parts into contact with each other on the mating surfaces 20*a*, 21*a*).

Figure 7:
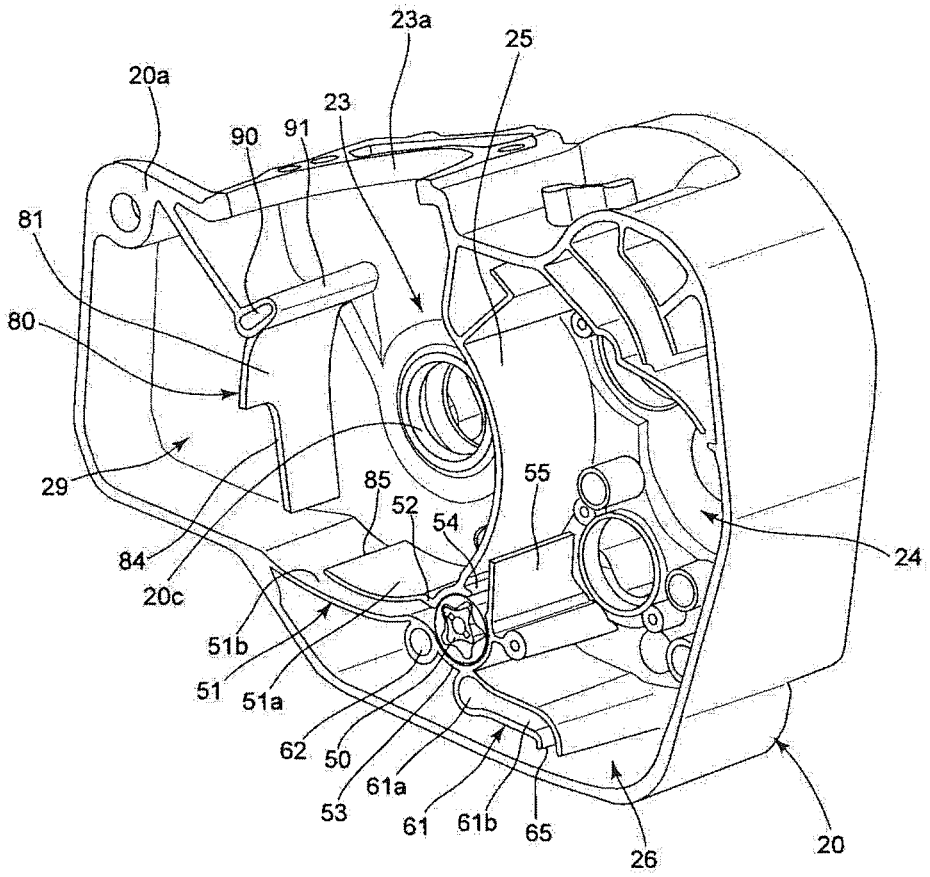
FIG. 7 is a perspective view depicting the inside of the right crankcase, in which components of a driving system are demounted.

Only a side, which is directed toward the right crankcase 20, of the pump accommodation part 53 has a completely hollow cylindrical internal structure configured to accommodate therein the scavenging pump 50 (refer to FIGS. 5 to 7). As shown in FIG. 17, the scavenging pump 50 is provided at a position close to a center of the crankcase 11 in the width direction, which is close to the mating surface 20*a* of the right crankcase 20. The left crankcase 21 is provided with a cylindrical part configuring the outer periphery part of the pump accommodation part 53 and an inside wall 58 radially extending in the cylindrical part, and a space between the suction port 52 and the discharge port 54 is partially partitioned by the inside wall 58 (refer to FIG. 10).

Figure 12:
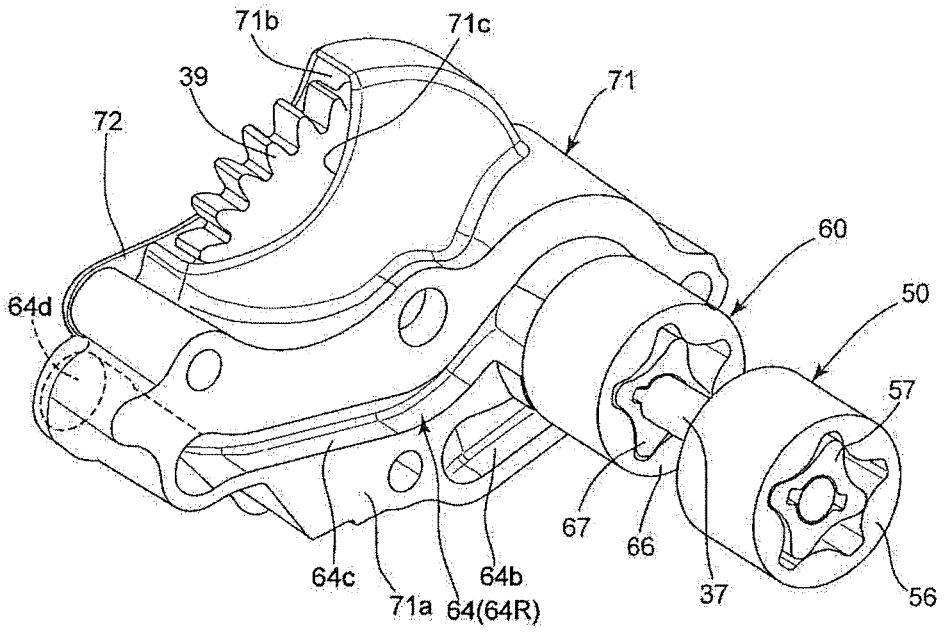
FIG. 12 is a perspective view of a pump unit and a pump cover.
Figure 13:
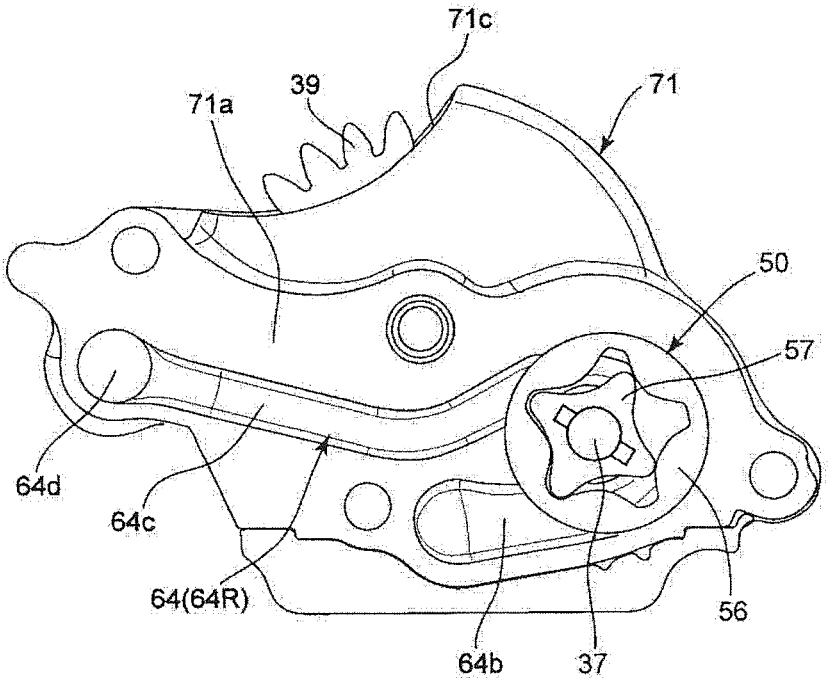
FIG. 13 is a side view of the pump unit and the pump cover, as seen from the left side.

As shown in FIGS. 12 and 13, the scavenging pump 50 provided in the pump accommodation part 53 is a trochoid pump, and an inner rotor 57 having external teeth of which number is smaller than the number of internal teeth is eccentrically mounted in an outer rotor 56 having the internal teeth. An outer peripheral surface of the cylindrical outer rotor 56 is rotatably supported to an inner peripheral surface of the pump accommodation part 53. The pump drive shaft 37 is inserted in the inner rotor 57. The inserted part is fitted to have a non-circular section, and the inner rotor 57 is configured to rotate integrally with the pump drive shaft 37. When the inner rotor 57 rotates, the outer rotor 56 also rotates, and a volume of a gap between the outer rotor 56 and the inner rotor 57 changes due to differences of the numbers of teeth and centers of the outer rotor 56 and the inner rotor 57. At a position at which the gap volume increases, the oil is sucked from the suction port 52, and at a position at which the gap volume decreases, the oil is discharged to the discharge port 54. The oil discharged to the discharge port 54 passes through between the partition wall 25 and the discharge guide rib 55 and enters the transmission chamber 24.

The scavenging pump 50 configures a pump mechanism for discharging the oil from the crank chamber 23. The scavenging pump 50 is brought close to the axis center (the main journal 30*c*) of the crankshaft 30, so that it is possible to downsize a structure around the crank chamber 23 including the pump mechanism. Also, when the oil passage before and after the scavenging pump 50 is made short, it is possible to downsize the structure, to make it difficult for the pressure loss to occur, and to easily improve the performance of the scavenging pump 50. In the illustrative embodiment, the scavenging pump 50 is arranged in a space-efficient manner with keeping the oil discharge performance, so that the engine unit 10 is made compact.

As a basic arrangement of the scavenging pump 50, the scavenging pump is provided below and at the rear with respect to the axis center of the crankshaft 30. Thereby, the scavenging pump 50 is positioned closely to the bottom part of the crank chamber 23 and the transmission chamber 24, so that it is possible to efficiently discharge the oil, which is to be accumulated at the bottom part of the crank chamber 23, to the transmission chamber 24 with the short oil passage. Also, since the arrangement place is a region, which does not overlap with a moveable region of the connecting rod 32 for piston or the connecting rod 35 for balancer, which is a long member extending upward or forward from the crank pin 30*a*, it is possible to easily arrange the scavenging pump 50 at a place close to the crankshaft 30.

The partition wall 25 configuring the rear end and lower end of the crank chamber 23 and the oil suction passage 51 have a curved shape conforming to a rotation locus of the outer periphery part of the counter weight 30*d* of the crankshaft 30, respectively. For this reason, when the engine unit 10 is seen from a side, a substantially triangular space surrounded by the two virtual lines P1, P2 and the rotation locus of the outer periphery part of the counter weight 30*d* is formed at an oblique lower side of the rear of the crankshaft 30 (refer to FIGS. 5 and 6). The scavenging pump 50 and the oil passage (from the oil suction passage 51 to the discharge guide rib 55) before and after the scavenging pump are arranged to fill the space, so that the space efficiency is extremely high.

Specifically, as shown in FIGS. 5 and 6, the rear end of the scavenging pump 50 is positioned ahead of the rear end (the virtual line P1) of the crank chamber 23 in the front and rear direction. Also, a half or more part, which includes the inner rotor 57 (the insertion place of the pump drive shaft 37), of the scavenging pump 50 is located at a position higher than the lower end (the virtual line P2) of the crank chamber 23 in the vertical direction. In other words, the entire scavenging pump 50 is positioned in front of the rear end of the partition wall 25, and at least a part of the scavenging pump 50 is positioned above the lower end of the crank chamber 23. This arrangement condition is satisfied, so that it is possible to arrange the scavenging pump 50 at a position close to the axis center of the crankshaft 30 and to make the engine unit 10 more compact than a scavenging pump of the related art.

Also, the above arrangement condition is satisfied, so that relative positions of the scavenging pump 50 and a driving mechanism thereof to the oil surface in the engine get higher, as compared to a configuration where the entire scavenging pump is arranged at a position lower than the lower end of the crank chamber 23. The mechanism configured to transmit the rotation of the crankshaft 30 to the pump drive shaft 37 and to thereby drive the scavenging pump 50 includes the prime mover gear 36, the pump driving gear 38 and the relay gear 39. When positions of the respective gears are higher relatively to the oil surface, it is possible to suppress a resistance, which is caused when stirring the oil with each gear, and to reduce a driving loss. Also, it is possible to suppress air bubbles of the oil, which are caused due to the stirring by each gear. The engine unit 10 of the illustrative embodiment has a configuration (a pump cover 71, a gear cover 72, and the like) for further improving the above effects, and the configuration will be described later.

Also, since the protruding amount of the scavenging pump 50 toward the oil chamber 26 positioned below the crank chamber 23 is reduced as a result of the above arrangement condition, it is possible to save the space in the vertical direction and to suppress a height of the oil chamber 26. The height of the oil chamber 26 is suppressed, so that when the engine unit 10 is mounted to a vehicle such as a motorcycle, it is possible to easily secure the lowest ground height from the bottom surface of the engine unit 10 to the ground.

The suction port 52 opens obliquely upward from the pump accommodation part 53, and the entire suction port 52 is positioned above the lower end (the virtual line P2) of the crank chamber 23. Thereby, it is possible to smoothly configure the suction-side oil passage in a space-efficient manner from the curved oil suction passage 51 convex downward toward the scavenging pump 50 most of which is located above the lower curved wall 51*b* (i.e., satisfies the above arrangement condition).

The scavenging pump 50 is positioned below the partition wall 25, and the discharge port 54 is positioned ahead of the rear end (the virtual line P1) of the crank chamber 23. The discharge guide rib 55 extends upward from the rear of the discharge port 54 substantially along the virtual line P1. In other words, the discharge guide rib 55 extends in a tangential direction to the rear end of the curved partition wall 25. An interval between the partition wall 25 and the discharge guide rib 55 gradually decreases toward the upper as being spaced from the discharge port 54. Therefore, the oil discharged from the discharge port 54 goes upward while the advancing in the front and rear direction is restrained by the partition wall 25 and the discharge guide rib 55.

The partition wall 25 protrudes rearward beyond the discharge guide rib 55 above an upper end portion of the discharge guide rib 55 to configure a rear wall surface directed obliquely downward. For this reason, the oil having reached the upper end portion of the discharge guide rib 55 collides with the partition wall 25 (adjacent to the rear end of the crank chamber 23) protruding upward, changes the advancing direction in an obliquely downward direction, enters the transmission chamber 24, and falls to the oil chamber 26.

An amount of the oil to be supplied to the transmission mechanism (the drive shaft 40, the counter shaft 41, the gear groups 42, 43, and the like) in the transmission chamber 24 is managed by an oil supply path (which will be described in detail later) via the feed pump 60. For this reason, if the oil discharged from the scavenging pump 50 scatters toward the transmission mechanism and is attached thereto, the stirring resistance may be increased due to the excessive supply of the oil. The discharge port 54 is arranged in front of the rear end of the crank chamber 23 and the discharge guide rib 55 is provided at the rear of the discharge port 54. Thereby, a discharge direction of the oil from the scavenging pump 50 is controlled so that the oil is not to directly scatter toward the transmission mechanism in the transmission chamber 24. For this reason, it is possible to prevent the oil from being excessively supplied to the transmission mechanism, so that it is possible to reduce the driving loss.

Also, as described above, the oil that is guided by the discharge guide rib 55 collides with the partition wall 25 having a shape protruding upward (having an angle of elevation), changes the advancing direction in the obliquely downward direction, and enters the transmission chamber 24. Thereby, it is possible to collect the oil to the oil chamber 26 more promptly and securely, as compared to a configuration where the oil is ejected upward and naturally drops. That is, in addition to the discharge guide rib 55, the partition wall 25 of which the rearward protruding amount increases toward the upper is also involved in the control of the oil discharge direction from the scavenging pump 50 to the transmission chamber 24.

As shown in FIGS. 5 and 6, the upper end portion of the discharge guide rib 55 is positioned slightly above the reference oil surface position OL. Also, the discharge guide rib 55 has a length traversing in the right and left direction in the crankcase 11. By the configurations, in the engine stop state, the back-flow of the oil from the oil chamber 26 to the scavenging pump 50 is prevented by the discharge guide rib 55, and upon the engine start, the oil stirring resistance relating to the driving of the scavenging pump 50 can be suppressed. Also, as compared to a configuration where the discharge guide rib 55 is not provided, it is possible to set the reference oil surface position OL (the oil surface position at which the back-flow of the oil to the scavenging pump 50 is not caused) at a high position. As a result, it is possible to increase a degree of freedom of a size setting of the engine unit 10 in the vertical direction while securing the effective capacity of the oil chamber 26. Specifically, it is possible to suppress an entire height (a height from the bottom surface of the oil chamber 26 to a top of the cylinder head cover 14) while securing the lowest ground height of the engine unit 10, thereby implementing the compactness in the vertical direction.

The feed pump 60 that is supported on the same axis as the scavenging pump 50 by the pump drive shaft 37 is positioned between the scavenging pump 50 and the pump driving gear 38 in the right and left direction (refer to FIG. 17). An oil passage relating to the feed pump 60 is provided to traverse in the right and left direction in the crankcase 11. The oil passage has a first oil passage 61 passing below the scavenging pump 50 and extending in the right and left direction, a second oil passage 62 passing the front of the scavenging pump 50 and extending in the right and left direction, a strainer chamber 63 formed at the left of the crankcase 11, and a pump accommodation part 64 provided at the right of the crankcase 11.

The first oil passage 61 has a tube-shaped part 61*a* passing below the pump accommodation part 53 (the scavenging pump 50) and extending in the right and left direction and a rearward extension part 61*b* extending rearward from the tube-shaped part 61*a*, and a rear end of the rearward extension part 61*b* is formed with a suction port 65, which is a downward opening. The tube-shaped part 61*a* is formed integrally with the pump accommodation part 53. The first oil passage 61 is formed by butting a wall part, which protrudes leftward from the inner surface of the right crankcase 20, and a wall part, which protrudes rightward from the inner surface of the left crankcase 21, on the mating surface 20*a* and the mating surface 21*a*, and traverses in the right and left direction in the crankcase 11. The suction port 65 is formed only within a partial range adjacent to a center in the right and left direction, in which the mating surface 20*a* and the mating surface 21*a* are interposed.

The second oil passage 62 has a circular tube shape passing immediately below the suction port 52 and extending in the right and left direction. The suction port 52 and the second oil passage 62 share a part of structures thereof, and a part of the circular tube shape forming the second oil passage 62 configures a part, which connects to the lower curved wall 51*b* of the oil suction passage 51, of the suction port 52. Therefore, like the suction port 52, the second oil passage 62 is formed by butting a wall part, which protrudes leftward from the inner surface of the right crankcase 20, and a wall part, which protrudes rightward from the inner surface of the left crankcase 21, on the mating surface 20*a* and the mating surface 21*a*, and traverses in the right and left direction in the crankcase 11.

As shown in FIG. 11, the strainer chamber 63 is positioned below the power generator chamber 28, and is formed as a space surrounded by a wall part protruding to the left surface of the left crankcase 21 and configuring the mating surface 21*b*. The power generator chamber 28 and the strainer chamber 63 are partitioned therebetween by the wall part, so that the oil does not directly flow therebetween. The magneto cover 16 has a cover part configured to close the left of the strainer chamber 63 with being mounted to the left crankcase 21, and the strainer chamber 63 is a space sealed with respect to the outside of the engine unit 10.

The strainer chamber 63 is formed with a pass-through portion 63*a* and a pass-through portion 63*b* penetrating the left crankcase 21 in the right and left direction. The pass-through portion 63*a* positioned at a lower side is formed to communicate with a left end portion of the tube-shaped part 61*a* of the first oil passage 61. The pass-through portion 63*b* located at an upper side is formed to communicate with a left end portion of the second oil passage 62.

In the strainer chamber 63, an oil strainer 70 is accommodated. The oil strainer 70 is made by forming a metallic net-shaped body into a plate shape, and is supported at a position at which the pass-through portion 63*a* and the pass-through portion 63*b* are demarcated therebetween. As shown in FIG. 11, when seen from a side of the engine unit 10 in the width direction, parts of the scavenging pump 50 and the feed pump 60 (shown with a dashed-dotted line in FIG. 11) are overlapped with the oil strainer 70.

The pump accommodation part 64 is a spaced formed by a first concave part 64L (refer to FIG. 9) provided on the right surface of the right crankcase 20 and a second concave part 64R provided on a pump cover 71 (refer to FIGS. 12 and 13) mounted to the right surface of the right crankcase 20. The right surface of the right crankcase 20 is formed with a mating surface 20*e* (FIGS. 9 and 17), and the first concave part 64L is formed to be concave relative to the mating surface 20*e*. The pump cover 71 has a mating surface 71*a* facing the mating surface 20*e*, and the second concave part 64R is formed to be concave relative to the mating surface 71*a*. The pump cover 71 is fastened and fixed to the right crankcase 20 with the mating surface 20*e* and the mating surface 71*a* being in contact with each other, so that the first concave part 64L and the second concave part 64R are joined with facing each other and the pump accommodation part 64 is thus formed. The first concave part 64L of the right crankcase 20 configures a left half part of the pump accommodation part 64, and the second concave part 64R of the pump cover 71 configures a right half part of the pump accommodation part 64.

The first concave part 64L of the pump accommodation part 64 is formed therein with a pass-through portion 64*a* penetrating the right crankcase 20 in the right and left direction. The pass-through portion 64*a* is formed to communicate with a right end portion of the second oil passage 62. The pump accommodation part 64 has a suction passage 64*b* extending obliquely rearward from one end portion formed to communicate with the pass-through portion 64*a* and a discharge passage 64*c* extending forward with being bent relative to the suction passage 64*b*. The bent part between the suction passage 64*b* and the discharge passage 64*c* has a cylindrical inner surface shape, and the feed pump 60 is arranged in the bent part. More specifically, the first concave part 64L of the right crankcase 20 is formed therein with a cylindrical part for accommodating the feed pump 60 (refer to FIG. 17) and the feed pump 60 is not inserted in the second concave part 64R of the pump cover 71 (refer to FIG. 12).

As shown in FIG. 12, the feed pump 60 provided in the pump accommodation part 64 is a trochoid pump similar to the scavenging pump 50, and an inner rotor 67 having external teeth of which the number is smaller than internal teeth is eccentrically mounted in an outer rotor 66 having the internal teeth. An outer peripheral surface of the cylindrical outer rotor 66 is rotatably supported to an inner peripheral surface of the bent part of the pump accommodation part 64. The pump drive shaft 37 is inserted in the inner rotor 67. The inserted part is fitted to have a non-circular section, and the inner rotor 67 is configured to rotate integrally with the pump drive shaft 37. When the inner rotor 67 rotates, the outer rotor 66 also rotates, and a volume of a gap between the outer rotor 66 and the inner rotor 67 changes due to differences of the numbers of teeth and centers of the outer rotor 66 and the inner rotor 67. At a position at which the gap volume decreases, the oil is sucked from the suction passage 64*b*, and at a position at which the gap volume increases, the oil is discharged to the discharge passage 64*c*.

The pump cover 71 is formed with a discharge hole 64*d* configured to communicate with an end portion of the discharge passage 64*c* of the pump accommodation part 64 (refer to FIGS. 8 and 13). An oil passage (not shown) configured to guide the oil from the discharge hole 64*d* to the oil filter 17 is provided.

When the feed pump 60 is operated by the rotation of the pump drive shaft 37, the oil retained in the oil chamber 26 is sucked to the first oil passage 61 through the suction port 65. The oil having entered the first oil passage 61 enters the strainer chamber 63 through the pass-through portion 63*a*, and relatively large foreign matters are removed by the oil strainer 70. The oil filtered by the oil strainer 70 enters the second oil passage 62 from the pass-through portion 63*b*, traverses the inside of the crankcase 11 and enters the pump accommodation part 64 from the pass-through portion 64*a*. The oil sucked to the feed pump 60 from the suction passage 64*b* is discharged to the discharge passage 64*c* and is pneumatically fed to the oil filter 17 via the discharge hole 64*d*. Although an oil passage from the oil filter 17 to a part thereafter is not shown, the oil pneumatically fed by the feed pump 60 passes through the oil filter 17 for removing fine foreign matters thereof, is then sent to each lubrication target part of the engine unit 10 and lubricates the same.

The oil having lubricated each lubrication target part of the engine unit 10 returns to the oil chamber 26. For example, the oil used to lubricate the crankshaft 30, the piston 31 and the like is accumulated at the bottom part of the crank chamber 23 and is discharged to the oil chamber 26 by the scavenging pump 50. The oil having lubricated the transmission mechanism and the like in the transmission chamber 24 directly falls to the oil chamber 26 from the transmission chamber 24. Also, the oil having flowed to the clutch chamber 27 and the power generator chamber 28 returns to the crankcase 11 through the through-holes formed in the right crankcase 20 and the left crankcase 21, and finally enters the oil chamber 26.

As described above, the first oil passage 61 and the second oil passage 62 configured to guide the oil from the oil chamber 26 to the feed pump 60 extend in parallel in the right and left direction and traverse the inside of the crankcase 11. The first oil passage 61 passes immediately below the scavenging pump 50, and the second oil passage 62 passes immediately below the suction port 52 ahead of the scavenging pump 50. That is, the first oil passage 61 and the second oil passage 62 extending in parallel with the pump drive shaft 37 are arranged in the vicinity of the pump unit having the scavenging pump 50 and the feed pump 60 provided on the same axis. By this arrangement, it is possible to downsize the entire lubrication system including the two pumps and the plurality of oil passages, so that it is possible to implement the miniaturization of the engine unit 10. Also, it is possible to shorten the first oil passage 61 and the second oil passage 62 reaching the feed pump 60 by the close arrangement to the pump unit. The shorter the oil passage is, the pressure loss is reduced when sending the oil. Accordingly, it is possible to improve the performance of the feed pump 60.

The first oil passage 61 is configured to suck the oil from the vicinity of the bottom part of the oil chamber 26 through the suction port 65. Therefore, when the first oil passage satisfies the condition that it is adjacent to the scavenging pump 50, the configuration where the first oil passage is positioned below the scavenging pump 50 is effective to shorten a length. Also, the pass-through portion 63*a*, which is configured to communicate with the first oil passage 61, of the strainer chamber 63 is provided below the pass-through portion 63*b* configured to communicate with the second oil passage 62 (refer to FIG. 11), and the first oil passage 61 is formed to connect the suction port 65 and the pass-through portion 63*a* (the strainer chamber 63) with a shortest distance in the right and left direction.

As shown in FIGS. 5 and 6, the second oil passage 62 is provided in front of the scavenging pump 50, and a part thereof is positioned above the lower end (the virtual line P2) of the crank chamber 23 in the vertical direction. As described above, the suction port 52 is formed using a part of the circular tube shape forming the second oil passage 62, and the suction port 52 and the second oil passage 62 are arranged side by side in the vertical direction in front of the scavenging pump 50. Since the entire suction port 52 is positioned above the lower end (the virtual line P2) of the crank chamber 23, a part of the second oil passage 62 also correspondingly enters the crank chamber 23. That is, the space-efficient configuration, which contributes to the volume securement of the oil chamber 26, is made.

Also, when the engine unit 10 is seen from a side, a part of the pump unit overlaps with the oil strainer 70 (refer to FIG. 11). In this way, the positions of the pump unit and the oil strainer 70 in the vertical direction and in the front and rear direction are aligned, so that the first oil passage 61 and the second oil passage 62 passing through the strainer chamber 63 are arranged in a balanced manner and the effects of shortening and downsizing the oil passage can be thus improved. For example, unlike the illustrative embodiment, if the positions of the feed pump 60 and the oil strainer 70 in the vertical direction largely deviate from each other, at least one of the first oil passage 61 and the second oil passage 62 is required to be largely tilted relative to the horizontal direction or to be bent in the vertical direction. As a result, the length of the oil passage increases and the space efficiency is deteriorated. In contrast, according to the configuration of the illustrative embodiment, it is possible to closely arrange the first oil passage 61 and the second oil passage 62 in parallel with each other, so that it is possible to implement the shortest passage configuration for passing through the strainer chamber 63.

The pump driving gear 38 and the relay gear 39 configuring a mechanism for extracting the drive force from the crankshaft 30 and transmitting the same to the pump drive shaft 37 are accommodated in a gear accommodation concave part 71*b* (refer to FIGS. 8 and 17) provided to the pump cover 71. The gear accommodation concave part 71*b* is a concave part formed on an opposite surface of the pump cover 71 to the mating surface 71*a*, and is covered from a side (a right side) by a separate gear cover 72. The gear accommodation concave part 71*b* is formed with an upward opening 71*c* directed upward. The gear cover 72 does not close the opening 71*c*. At a place except the opening 71*c*, the gear accommodation concave part 71*b* is spaced from an internal space of the clutch chamber 27. The opening 71*c* is positioned above the reference oil surface position OL (refer to FIG. 8).

As shown in FIGS. 8 and 17, in a state where the pump cover 71 is mounted to the right crankcase 20, one end of the pump drive shaft 37 protrudes into the gear accommodation concave part 71*b* and connects to the pump driving gear 38. The pump driving gear 38 is entirely accommodated in the gear accommodation concave part 71*b*. The relay gear 39 is a two-stage gear having a small-diameter gear and a large-diameter gear on the same axis. The small-diameter gear of the relay gear 39 is meshed with the pump driving gear 38 in the gear accommodation concave part 71*b*. The large-diameter gear of the relay gear 39 is partially exposed from the opening 71*c* and is meshed with the prime mover gear 36.

As described above, in correspondence to a configuration where at least a part of the scavenging pump 50 is positioned above the lower end (the virtual line P2) of the crank chamber 23, positions of the pump driving gear 38 positioned coaxially with the scavenging pump 50 and the relay gear 39 configured to mesh with the pump driving gear 38 are set high. The positions at which the pump driving gear 38 and the relay gear 39 are provided are close to a bottom part of the clutch chamber 27. Therefore, when the positions of the pump driving gear 38 and the relay gear 39 are set higher relative to the oil surface in the clutch chamber 27, it is possible to reduce the oil stirring resistance by the gears. In addition to this, the configuration where the pump driving gear 38 and the relay gear 39 are accommodated in the gear accommodation concave part 71*b* can further reduce the operating resistance to the respective gears 38, 39.

A part of the oil that is supplied to the clutch mechanism and the like in the clutch chamber 27 by using the feed pump 60 enters the gear accommodation concave part 71*b* through the opening 71*c* directed upward, thereby lubricating the pump driving gear 38 and the relay gear 39. At this time, since the gear accommodation concave part 71*b* is closed except the upward opening 71*c* and the opening 71*c* is positioned above the reference oil surface position OL, it is difficult for an excessive amount of the oil to enter the gear accommodation concave part 71*b*. Also, when driving the engine unit 10, the extra oil in the gear accommodation concave part 71*b* is discharged into the clutch chamber 27 through the opening 71*c* by centrifugal forces of the relay gear 39 and the pump driving gear 38 being rotating. Thereby, an appropriate amount of the oil is always supplied to the pump driving gear 38 and the relay gear 39, so that it is possible to reduce the operating resistance when driving the scavenging pump 50 and the feed pump 60.

A balancer device configured to use the swinging balancer weight 33 has an excellent vibration control effect and can substantially completely absorb the vibrations, which are caused due to the reciprocal movement of the piston system, as compared to a balancer device configured to use a rotating balancer that is to continuously rotate in one direction. Also, the number of components is small, and the configuration of the balancer device can also be simplified. In the meantime, in order to swing the elongated balancer weight 33 extending from the pivot pin 34 to the weight part 33*a*, a wide space to some extent is required. In the illustrative embodiment, the balancer weight 33 hanging down from the pivot pin 34 provided to an upper wall of the crankcase 11 is configured to swing in the front and rear direction. For this reason, a fan-shaped swinging space of which a center is the pivot pin 34 is provided ahead of the crank chamber 23 in the crankcase 11, and the space is configured as the balancer chamber 29.

In the crankcase 11, a partition wall 80 configured to partition the crank chamber 23 and the balancer chamber 29 is provided. The partition wall 80 is arranged to be symmetrical to the partition wall 25 in the front and rear direction with crank support holes 20*c*, 21*c* for supporting the crankshaft 30 being interposed therebetween, and is positioned in front of a moving locus of an outer peripheral surface of the counter weight 30*d* when the crankshaft 30 rotates.

As shown in FIGS. 14 to 16, the partition wall 80 has a first partition wall 81 provided at the right crankcase 20-side, and a second partition wall 82 provided at the left crankcase 21-side. The first partition wall 81 is a wall part protruding leftward from the inner surface of the right crankcase 20, and is formed integrally with the right crankcase 20. The second partition wall 82 is a wall part protruding rightward from the inner surface of the left crankcase 21, and is formed integrally with the left crankcase 21. The first partition wall 81 and the second partition wall 82 are separated in the right and left direction, and a gap 83 is formed therebetween.

In the crankcase 11, an oil passage 90 for piston jetting configured to inject the oil to the rear of the piston 31 is provided above the partition wall 80. Upper ends of the first partition wall 81 and the second partition wall 82 are positioned in the vicinity of the oil passage 90 (refer to FIGS. 3 to 7 and FIG. 10). More specifically, protrusions 91, 92 having the oil passage 90 formed therein protrude from the inner surfaces of the right crankcase 20 and the left crankcase 21 to the mating surfaces 20*a*, 21*a*. The upper end of the first partition wall 81 continues to a lower surface of the protrusion 91 provided to the right crankcase 20-side, and the upper end of the second partition wall 82 continues to a lower surface of the protrusion 92 provided to the left crankcase 21-side. The first partition wall 81 extends downward beyond the second partition wall 82, and a region below the gap 83 between the first partition wall and the second partition wall 82 and the gap 83 is configured as a notch 84 in which a wall surface of the partition wall 80 does not exist. The notch 84 enters a part of the first partition wall 81 (refer to FIGS. 14 and 16).

As shown in FIGS. 14 to 16, the connecting rod 32 for piston and the connecting rod 35 for balancer are supported side by side in the direction of the rotary shaft on the crankshaft 30, and a pair of crank webs 30*b* is provided at both sides thereof. The first partition wall 81 has a width in the right and left direction corresponding to the right crank web 30*b* and the connecting rod 32 for piston. Particularly, a part, which is positioned above the notch 84, of the first partition wall 81 has a wide width shape covering an entire width of the connecting rod 32 for piston. The second partition wall 82 has a width in the right and left direction corresponding to the left crank web 30*b*. That is, the first partition wall 81 positioned closely to (right side) the connecting rod 32 for piston in the right and left direction along the rotary shaft of the crankshaft 30 has a larger width in the right and left direction than the second partition wall 82 positioned closely to (left side) the connecting rod 35 for balancer. The gap 83 is formed at a position corresponding to the connecting rod 35 for balancer in the right and left direction (refer to FIG. 16). When the balancer device is seen from the front, the notch 84 is formed at a position overlapping with the weight part 33*a* of the balancer weight 33 in the right and left direction and in the vertical direction (refer to FIG. 16).

The connecting rod 35 for balancer extending from the crank chamber 23 to the balancer chamber 29 passes the gap 83 or the notch 84 at an intermediate part thereof all the time. Also, when swinging to a predetermined rear position, the weight part 33*a* of the balancer weight 33 comes close to (or enters) the notch 84. Accordingly, the balancer weight 33 and the connecting rod 35 for balancer can operate without interfering with the partition wall 80.

The first partition wall 81, which is longer than the second partition wall 82 in the vertical direction, extends to a position close to the bottom part of the crank chamber 23, and a lower end of the first partition wall 81 is positioned at a position lower than the lower end (the weight part 33*a*) of the balancer weight 33. The lower end of the first partition wall 81 is positioned on a forward extension line of a front end (an end portion directed toward the balancer chamber 29) of the oil suction passage 51 (refer to FIGS. 5 to 7). More specifically, the lower end of the first partition wall 81 is positioned on the extension that is formed if the upper curved wall 51*a* of the oil suction passage 51 extends forward while keeping the curved shape (curvature). An opening 85 configured to communicate in the vertical direction is formed between the lower end of the first partition wall 81 and the front end of the upper curved wall 51*a*, and a wall surface close to the front end of the lower curved wall 51*b* of the oil suction passage 51 is positioned below the opening 85.

The first partition wall 81 is configured so that the lower end is located at the most rearward position (the rotary shaft of the crankshaft 30-side) in the front and rear direction connecting the crank chamber 23 and the balancer chamber 29 and a forward protruding amount increases from the lower end toward the upper side. The first partition wall 81 parallel with the second partition wall 82 in the right and left direction has an arc-shaped curved shape, which conforms to the moving locus of the outer peripheral surface of the counter weight 30*d* when the crankshaft 30 rotates, in the vicinity of the upper end thereof. A virtual line P3 passing through the front end, which protrudes most forward, of the first partition wall 81 and extending in the perpendicular direction is shown in FIG. 6. The lower end of the first partition wall 81 is positioned at the rear of the virtual line P3. By the above-described curved shape, the upper end of the first partition wall 81 is also positioned at the rear of the virtual line P3. Like the first partition wall 81, the second partition wall 82 has also an arc-shaped curved shape conforming to the moving locus of the outer peripheral surface of the counter weight 30*d* (refer to FIG. 10).

Like the illustrative embodiment, the crankcase 11 of a left and right division type can be easily formed integrally with the partition wall, which is long in the vertical direction as the first partition wall 81, without providing a division line on the way. In case of a crankcase configured by case half bodies to be divided in the vertical direction, unlike the illustrative embodiment, the partition wall is divided on the way in the vertical direction and mating surfaces of case half bodies are positionally aligned with each other, or a partition wall largely protruding in the vertical direction from one case half body is provided. As a result, a degree of difficulty of the combination precision of components is high. In contrast, according to the partition wall 80 of the illustrative embodiment, the first partition wall 81 and the second partition wall 82 are separated with the gap 83 necessary for the connecting rod 35 for balancer to pass being interposed therebetween. Therefore, it is not necessary to surface-align the first partition wall 81 and the second partition wall 82, it is easy to manage the precision of components and the productivity is also excellent. Accordingly, when using the crankcase of a left and right division type, the first partition wall 81 and the second partition wall 82 are respectively formed integrally with the left and right crankcases 20, 21, so that the productivity is considerably improved.

In the meantime, unlike the shown configuration, the first partition wall 81 and the second partition wall 82 may be formed separately from the left and right crankcases 20, 21. In this case, a support seat configured to be supported with being in contact with the inner surface of the right crankcase 20 is provided to the first partition wall 81, a support seat configured to be supported with being in contact with the inner surface of the left crankcase 21 is provided to the second partition wall 82, and the respective support seats are fixed to the corresponding crankcases 20, 21. The configuration of mounting the first partition wall 81 and the second partition wall 82 to the respective crankcases 20, 21 can increase a degree of freedom of the shape of the partition wall 80.

In the crank chamber 23, the oil scatters around from the crankshaft 30 being rotating at high speed. The crank chamber 23 and the balancer chamber 29 are partitioned by the above partition wall 80, so that it is possible to limit the introduction of the extra oil from the crank chamber 23 into the balancer chamber 29. As shown in FIGS. 14 to 16, the first partition wall 81 positioned at the right side of the partition wall 80 has a larger area than the second partition wall 82, and can prevent the oil from being introduced into the balancer chamber 29 over a wide range from the inner surface of the right crankcase 20 to the connecting rod 32 for piston.

The second partition wall 82 positioned at the left side of the partition wall 80 has a smaller area. However, it is possible to obtain the effect of limiting the introduction of the oil into the balancer chamber 29 even by the balancer weight 33 and the connecting rod 35 for balancer biasedly positioned at the left of the axial center of the crankshaft 30. Therefore, it is possible to accomplish the sufficient oil control effect with the second partition wall 82 having the small area, in the left half region of the balancer chamber 29. In the meantime, the balancer weight 33 and the connecting rod 35 for balancer can contact the oil supplied from the crank chamber 23-side through the gap 83 and the notch 84. For this reason, there is no concern that the balancer weight 33 and the connecting rod 35 for balancer are to be insufficiently lubricated due to the partition wall 80.

The oil having collided with the partition wall 80 in the crank chamber 23 flows downward, enters the oil suction passage 51, is sucked and discharged by the scavenging pump 50 and is collected to the oil chamber 26. In particular, as shown in FIG. 6, since the lower end of the first partition wall 81 is positioned at the rearward side (more closely to the rotary shaft of the crankshaft 30) beyond the front end (the virtual line P3) positioned at the upper side, it is easy to guide the scattered oil toward the lower part of the crank chamber 23. Also, since the lower end of the first partition wall 81 is positioned on the forward extension line of the upper curved wall 51*a* and reaches the opening 85, which is an entry of the oil suction passage 51, it is easy to securely guide the oil to the scavenging pump 50 without any leakage. Accordingly, the oil collection efficiency by the partition wall 80 is improved.

As described above, according to the lubrication structure of an internal combustion engine of the illustrative embodiment, the scavenging pump 50 and the feed pump 60 are coaxially arranged and the scavenging pump 50 is then arranged at the position close to the crankshaft 30 in the front and rear direction and in the vertical direction, so that the lubrication structure is made compact. Also, the oil passage reaching the feed pump 60 via the oil strainer 70 is arranged in the vicinity of the scavenging pump 50, so that it is possible to improve the pump performance by the further compactness and the shortening of the oil passage. Also, since the configuration where the oil is difficult to be stirred in the mechanism for driving the respective pumps 50, 60 and the transmission mechanism is provided, it is possible to suppress the lowering of the driving efficiency.

In the meantime, the present invention is not limited to the illustrative embodiment and can be diversely changed and implemented. In the illustrative embodiment, the magnitudes, shapes and the like shown in the accompanying drawings are not limited thereto, and can be appropriately changed within the scope in which the effects of the present invention can be accomplished. Also, the illustrative embodiment can be can be appropriately changed and implemented without departing from the desired scope of the present invention.

For example, the engine unit 10 of the illustrative embodiment is a single cylinder engine. However, the present invention can be applied to an internal combustion engine having a different number of cylinders, as well.

In the illustrative embodiment, a part of the scavenging pump 50 is positioned below the lower end of the crank chamber 23. Unlike this configuration, the scavenging pump may be entirely arranged above the lower end of the crank chamber inasmuch as it is possible to secure the oil suction performance from the crank chamber without interfering with the constitutional elements (the crankshaft 30 and the like) of the crank chamber.

In the illustrative embodiment, the rear end of the scavenging pump 50 is positioned in front of the rear end of the crank chamber 23. However, even when the position of the rear end of the scavenging pump 50 is made to coincide with the position of the rear end of the crank chamber 23 in the front and rear direction, it is possible to accomplish the desired effects. Likewise, in the illustrative embodiment, the discharge port 54 and the discharge guide rib 55 are positioned ahead of the rear end of the crank chamber 23. However, the positions thereof in the front and rear direction may be made to coincide with the position of the rear end of the crank chamber 23.

As described above, the present invention has the effect of obtaining the lubrication structure of an internal combustion engine, which is compact and has excellent lubrication performance, and is particularly useful for an engine of a vehicle for which reduction in size and weight is required.

What is claimed is:

1. A lubrication structure of an internal combustion engine, comprising: a crank chamber having a crankshaft provided therein; a transmission chamber arranged adjacently at the rear of the crank chamber and having a transmission mechanism provided therein; an oil chamber configured to communicate with a bottom part of the transmission chamber; a feed pump configured to supply oil in the oil chamber to a lubrication target part; and a scavenging pump configured to suck the oil accumulated in the crank chamber and to discharge the oil to the transmission chamber, wherein the feed pump and the scavenging pump are arranged coaxially in a width direction of the internal combustion engine, in which a rotary shaft of the crankshaft extends, wherein at least a part of the scavenging pump is arranged at a position higher than a lower end of the crank chamber, and wherein a rear end of the scavenging pump is arranged at the same position as a rear end of the crank chamber or in front of the rear end of the crank chamber in a front and rear direction, wherein the lubrication structure further comprises a first oil passage extending from the oil chamber toward an oil strainer, and a second oil passage extending from the oil strainer toward the feed pump, wherein the first oil passage and the second oil passage extend in the width direction, passing through a position adjacent to the scavenging pump, and wherein a part of the oil strainer overlaps with the scavenging pump, as seen from a side in the width direction, the lubrication structure of the internal combustion engine further comprising a crankcase in which the crank chamber and the transmission chamber are formed, wherein the scavenging pump is provided at one side of the crankcase and the oil strainer is provided at another side of the crankcase such that the part of the oil strainer overlaps with the scavenging pump, as seen from the side in the width direction.

2. The lubrication structure of an internal combustion engine, according to claim 1, wherein the first oil passage is arranged below the scavenging pump, the second oil passage is arranged in front of the scavenging pump, and at least a part of the second oil passage is positioned at a position higher than the lower end of the crank chamber.

3. The lubrication structure of an internal combustion engine, according to claim 1, wherein a discharge port of the scavenging pump is arranged at the same position as the rear end of the crank chamber or in front of the rear end of the crank chamber in the front and rear direction.

4. The lubrication structure of an internal combustion engine, according to claim 3, further comprising a discharge guide part provided at the rear of the discharge port of the scavenging pump, extending upward and configured to limit an advancing direction of the oil toward the transmission chamber, wherein the discharge guide part is arranged at the same position as the rear end of the crank chamber or in front of the rear end of the crank chamber in the front and rear direction.

5. The lubrication structure of an internal combustion engine, according to claim 4, wherein the discharge guide part has a length traversing the oil chamber in the width direction, and an upper end portion of the discharge guide part is positioned above an oil surface in the oil chamber.

6. The lubrication structure of an internal combustion engine, according to claim 4, further comprising a partition wall configured to partition the crank chamber and the transmission chamber, wherein the discharge guide part is arranged at the rear of the partition wall with being spaced therefrom, and wherein the partition wall protrudes rearward beyond the discharge guide part above an upper end portion of the discharge guide part.

* * * * *